US007995080B2

(12) United States Patent
Abe et al.

(10) Patent No.: US 7,995,080 B2
(45) Date of Patent: Aug. 9, 2011

(54) IMAGE DISPLAY APPARATUS

(75) Inventors: Naoto Abe, Machida (JP); Eisaku Tatsumi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 903 days.

(21) Appl. No.: 11/951,657

(22) Filed: Dec. 6, 2007

(65) Prior Publication Data

US 2008/0136846 A1 Jun. 12, 2008

(30) Foreign Application Priority Data

Dec. 6, 2006 (JP) ..... 2006-329307

(51) Int. Cl.
*G09G 5/10* (2006.01)

(52) U.S. Cl. ..... 345/690; 345/89

(58) Field of Classification Search ..... 345/75.2, 345/77, 78, 690–693, 76, 88, 89
See application file for complete search history.

(56) References Cited

U.S. PATENT DOCUMENTS

| | | | | |
|---|---|---|---|---|
| 6,310,662 | B1 | 10/2001 | Sunakawa et al. | 348/747 |
| 6,552,702 | B1 | 4/2003 | Abe et al. | 345/75.2 |
| 6,603,450 | B1 | 8/2003 | Yamazaki et al. | 345/75.2 |
| 7,009,627 | B2 | 3/2006 | Abe et al. | 345/690 |
| 7,154,457 | B2 | 12/2006 | Sagano et al. | 345/78 |
| 7,307,606 | B1 | 12/2007 | Yamazaki et al. | 345/77 |
| 2004/0246277 | A1 | 12/2004 | Abe et al. | 345/690 |
| 2005/0012821 | A1 | 1/2005 | Kanai | |
| 2006/0209215 | A1 * | 9/2006 | Arai | 348/712 |
| 2006/0256142 | A1 | 11/2006 | Sagano et al. | 345/690 |

FOREIGN PATENT DOCUMENTS

| | | |
|---|---|---|
| JP | 2000-122598 | 4/2000 |
| JP | 2005-221525 | 8/2005 |
| WO | WO 2005/124734 | 12/2005 |

* cited by examiner

*Primary Examiner* — Amare Mengistu
*Assistant Examiner* — Hong Zhou
(74) *Attorney, Agent, or Firm* — Fitzpatrick, Cella, Harper & Scinto

(57) ABSTRACT

A drive circuit of an image display apparatus has a correction circuit for outputting driving data that is corrected on the basis of a correction value. The correction value corrects variation of brightness of a plurality of pixels. The correction is such that the number of pixels to be darkened by the correction when the driving data inputted for the plurality of pixels have a common first value is fewer than the number of pixels to be darkened by the correction when the driving data inputted for the plurality of pixels have a common second value larger than the first value.

17 Claims, 18 Drawing Sheets

FIG. 11A

LUMINANCE (NO CORRECTION)
AT HIGH GRADATION (HIGH LUMINANCE)

| | | | |
|---|---|---|---|
| 400 | 407 | 386 | 374 |
| 465 | 325 | 413 | 493 |
| 423 | 403 | 392 | 398 |
| 429 | 341 | 389 | 362 |

AVERAGE : 400cd/m$^2$
STANDARD DEVIATION ( $\sigma$ ) : 41.7cd/m$^2$
STANDARD DEVIATION/AVERAGE : 10.4%

FIG. 11B

LUMINANCE (NO CORRECTION)
AT LOW GRADATION (LOW LUMINANCE)

| | | | |
|---|---|---|---|
| 7.0 | 9.8 | 9.2 | 7.8 |
| 4.1 | 14.1 | 9.5 | 11.6 |
| 15.1 | 10.0 | 10.6 | 10.1 |
| 6.4 | 13.8 | 11.0 | 9.9 |

AVERAGE : 10cd/m$^2$
STANDARD DEVIATION ( $\sigma$ ) : 2.87cd/m$^2$
STANDARD DEVIATION/AVERAGE : 28.7%

FIG. 12A

CORRECTION DATA
AT HIGH GRADATION (HIGH LUMINANCE)

| | | | |
|---|---|---|---|
| 0.70 | 0.69 | 0.73 | 0.75 |
| 0.60 | 0.86 | 0.68 | 0.57 |
| 0.66 | 0.69 | 0.71 | 0.70 |
| 0.65 | 0.82 | 0.72 | 0.77 |

TARGET VALUE: AVERAGE $-3\sigma \fallingdotseq 280\text{cd/m}^2$

CORRECTION DATA FOR DEVICE OF AVERAGE VALUE : 0.70

FIG. 12B

CORRECTION DATA
AT LOW GRADATION (LOW LUMINANCE)

| | | | |
|---|---|---|---|
| 1.00 | 0.71 | 0.76 | 0.90 |
| 1.71 | 0.50 | 0.74 | 0.64 |
| 0.46 | 0.70 | 0.66 | 0.69 |
| 1.09 | 0.51 | 0.64 | 0.71 |

TARGET VALUE: AVERAGE $\times 0.70 = 7.0\text{cd/m}^2$

CORRECTION DATA FOR DEVICE OF AVERAGE VALUE : 0.70

IMAGE DISPLAY APPARATUS

BACKGROUND OF THE INVENTION

1. Field of the Invention

The present invention relates to an image display apparatus, and particularly, the present invention relates to correction of brightness unevenness of an image display apparatus having a plurality of pixels.

2. Description of the Related Art

Japanese Patent Application Laid-Open (JP-A) No. 2000-122598 discloses that luminance variation of each display device of an organic electroluminescence display apparatus is corrected and a luminescent indication value is multiplexed defining a correction value of a correction value table as a gain in order to realize a display without luminance unevenness. In addition, JP-A No. 2000-122598 discloses that correction value tables equivalent to the number of gradations are prepared, the luminescent indication value is inputted in the correction value table, and the luminescent indication value is corrected due to output of the correction value table for variation of current-luminance characteristic.

In addition, JP-A No. 2005-221525 discloses that an image display apparatus having a surface conduction electron-emitting device arranged therein corrects light emission unevenness in two stages, namely, device correction and bit correction in order to realize display without the light emission unevenness.

In addition, International Publication No. 2005/124734 discloses the constitution having a plurality of correction values as a correction value corresponding to one pixel.

SUMMARY OF THE INVENTION

It is possible to decrease variation in brightness by using a correction value to darken a pixel that is brighter than reference brightness for this pixel as a correction value for correcting variation in brightness and by using a correction value to brighten a pixel that is darker than the reference brightness for this pixel as a correction value for correcting variation in brightness.

For example, measuring the brightness when the same driving data is inputted, the value obtained by dividing the reference brightness by the measured brightness can be used as the correction value.

Sometimes variation of brightness may be different depending on the driving data. In other words, variation of brightness when the driving data of a certain value is applied to each pixel is different from unevenness of brightness when the driving data having a larger value than the value of the foregoing driving data is applied to each pixel.

By preparing the correction value corresponding to each of a plurality of driving data, it is possible to appropriately correct each driving data in accordance with the driving data.

The corrected driving data is used for generating a modulation signal in a circuit of its rear stage or is applied with other signal processing. In a circuit of a rear stage for generating the corrected driving data such as a circuit for generating the modulation signal and a circuit for carrying out other signal processing, in the case that the upper limit of the value which can be inputted is determined, overflow is generated if the value of the corrected driving data exceeds its upper limit. This overflow itself leads to a problem such that the operation of the circuit is made unstable. In addition, an abnormality arises in a value due to return by the overflow.

The correction value is set to be low in order to prevent the overflow so that the obtained brightness is made smaller.

The present invention provides an art for decreasing unevenness of brightness of a screen. In addition, the present invention provides an art for realizing appropriate correction in the constitution that a correction value, which is different depending on the value of the driving data, is used as a correction value for correcting unevenness of brightness.

The first aspect of the present invention provides an image display apparatus including: a plurality of pixels; and a drive circuit for outputting a modulation signal that drives the pixels on the basis of the inputted driving data, wherein the drive circuit has a correction circuit for outputting the driving data that is corrected on the basis of a correction value, and wherein the correction value is a correction value that corrects variation of brightness of the plurality of pixels, and wherein the correction on the basis of the correction value is a correction such that the number of pixels to be darkened by the correction when the driving data inputted for the plurality of pixels have a common first value is fewer than the number of pixels to be darkened by the correction when the driving data inputted for the plurality of pixels have a common second value larger than the first value.

The second aspect of the present invention provides an image display apparatus including: a plurality of pixels; and a drive circuit for outputting a modulation signal that drives the pixels on the basis of the inputted driving data, wherein the drive circuit having: a correction value output circuit for outputting a first correction value for each of the plurality of pixels when the inputted driving data is a first value, the first correction value being used for correcting the driving data so that brightness of the pixel driven on the basis of the driving data comes close to a first brightness that is a reference, and for outputting a second correction value for each of the plurality of pixels when the inputted driving data is a second value larger than the first value, the second correction value being used for correcting the driving data so that brightness of the pixel driven on the basis of the driving data comes close to a second brightness that is a reference; and a correction circuit for carrying out correction on the basis of the correction value outputted from the correction value output circuit, and wherein the number of the correction values to lower brightness of the pixel among the plurality of second correction values corresponding to the plurality of pixels is more than the number of the correction values to lower brightness of the pixel among the plurality of first correction values corresponding to the plurality of pixels.

The third aspect of the present invention provides an image display apparatus including: a plurality of pixels; and a drive circuit for outputting a modulation signal that drives the pixels on the basis of the inputted driving data, wherein the drive circuit having: a correction value output circuit for outputting a correction value in order to correct variation of brightness of a plurality of pixels; and a correction circuit for carrying out correction on the basis of the correction value that is outputted from the correction value output circuit, and wherein the correction value output circuit can output a first correction value and a second correction value for each of the plurality of pixels, and wherein the correction value output circuit outputs: (a) the first correction value, for a pixel which has brightness lower than a first brightness in case of driven on the basis of driving data of a first value without correction by the correction circuit, in order to heighten the brightness of the pixel, when the inputted driving data is the first value; (b) the first correction value, for a pixel which has brightness higher than the first brightness in case of driven on the basis of driving data of the first value without correction by the correction circuit, in order to lower the brightness of the pixel, when the inputted driving data is the first value; (c) the second correction value, for a pixel which has brightness lower than a second brightness in case of driven on the basis of driving data of a second value larger than the first value without correction by the correction circuit, in order to heighten the brightness of the pixel, when the inputted driving data is the second value; and (d) the second correction value, for a pixel which has brightness higher than the second brightness in case of driven on the basis of driving data of the second value without correction by the correction circuit, in order to lower the brightness of the pixel, when the inputted driving data is the second value, and wherein the number of pixels that are brighter than the first brightness in the case that the plurality of pixels are driven on the basis of the driving data of the first value without the correction by the correction circuit is fewer than the number of pixels that are brighter than the second brightness in the case that the plurality of pixels are driven on the basis of the driving data of the second value without the correction by the correction circuit.

According to the present invention, it is possible to decrease unevenness of brightness. In addition, in the constitution using a correction value, which is different depending on the value of the driving data, as a correction value for correcting variation of brightness, the appropriate correction can be realized.

Further features of the present invention will become apparent from the following description of exemplary embodiments with reference to the attached drawings.

BRIEF DESCRIPTION OF THE DRAWINGS

FIG. 11A shows an example of matrix representing a luminance of each display device when high luminance data is inputted;

FIG. 11B shows an example of matrix representing a luminance of each display device when low luminance data is inputted;

FIG. 12A shows a correction data set at a high luminance where the luminance variation shown in FIG. 11A is obtained;

FIG. 12B shows a correction data set at a low luminance where the luminance variation shown in FIG. 11B is obtained;

DESCRIPTION OF THE EMBODIMENTS

Figure 1:
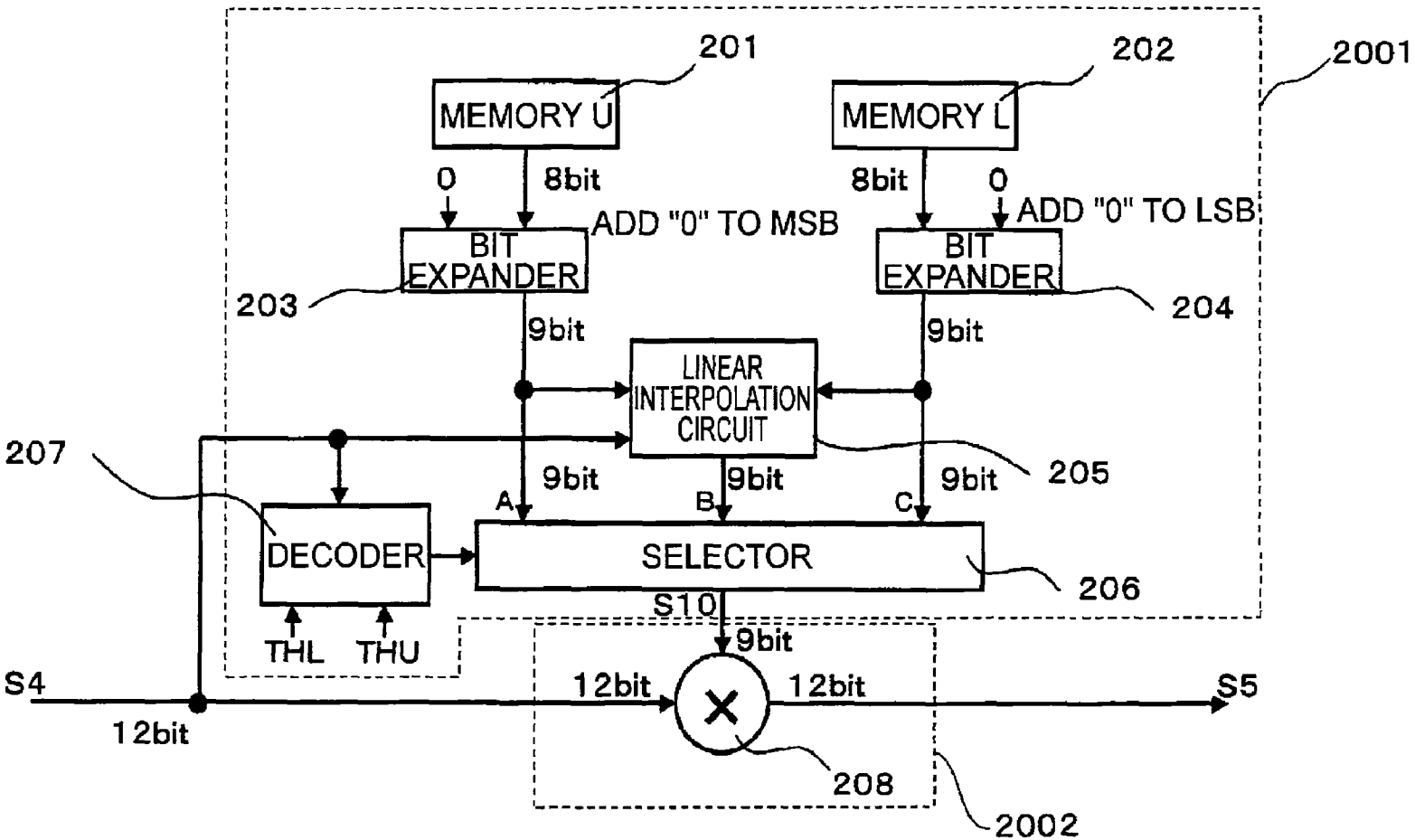
FIG. 1 is an explanatory view showing a correction unit of a first embodiment according to the present invention.

An image display apparatus according to the present invention includes a combination of an electron source and a light-emitting member to emit a light by an electron emitted from the electron source as a pixel and one using a plasma light-emitting cell, a liquid crystal device, a minute mirror, and an EL device as a pixel. As an electron-emitting device structuring the electron source, a surface conduction electron-emitting device, a field emission type electron-emitting device, and a metal-insulator-metal type electron-emitting device or the like can be used. As an electron-emitting portion of the electron-emitting device, a Spindt-type emitter cone, a graphite nano fiber (GNF), and a carbon nano tube (CNT) or the like can be preferably adopted. Particularly, the image display apparatus of a large area using the electron source has a possibility that unevenness of brightness is generated due to variation of emission current of the electron-emitting device or the like. Therefore, the image display apparatus of the large area (a diagonal size of a screen is not less than 30 inches) using the electron source is a preferable embodiment to which the present invention is applied.

In the image display apparatus, the constitution that one pixel is formed by a plurality of sub-pixels of different colors so as to display many colors has been known. For example, it becomes possible to represent many colors by forming one pixel combining a red sub-pixel, a blue sub-pixel, and a green sub-pixel. The pixel defined by the present invention can be used as a sub-pixel in this constitution. In addition, one pixel formed by combining a plurality of sub-pixels can be also treated as a pixel according to the present invention. Accordingly, the sub-pixel and the pixel are not particularly distinguished herein. Further, the pixel will be explained below as a display element.

In addition, as a value of brightness herein, a value measured by a luminance meter can be preferably adopted. In the following explanation, as the value showing the brightness, the luminance will be adopted.

In addition, according to the present embodiment, a plurality of correction values corresponding to the same display element obtained under a condition that a luminance is different (corresponding to a first correction value and a second correction value, and the first correction value and the second correction value are also referred to as a correction data set as a whole) is used. Thereby, even an image display apparatus using a display panel where luminance variation distributions of a plurality of display elements are different depending on a luminance can preferably reduce luminance variation. As a result, the present invention is preferable for the image display apparatus involving a problem about luminance unevenness. For example, the present invention can be preferably applied to a PC monitor and a television set of a full color displaying a natural image, particularly, a moving image.

First Embodiment

The first embodiment according to the present invention will be described below.

Figure 2:
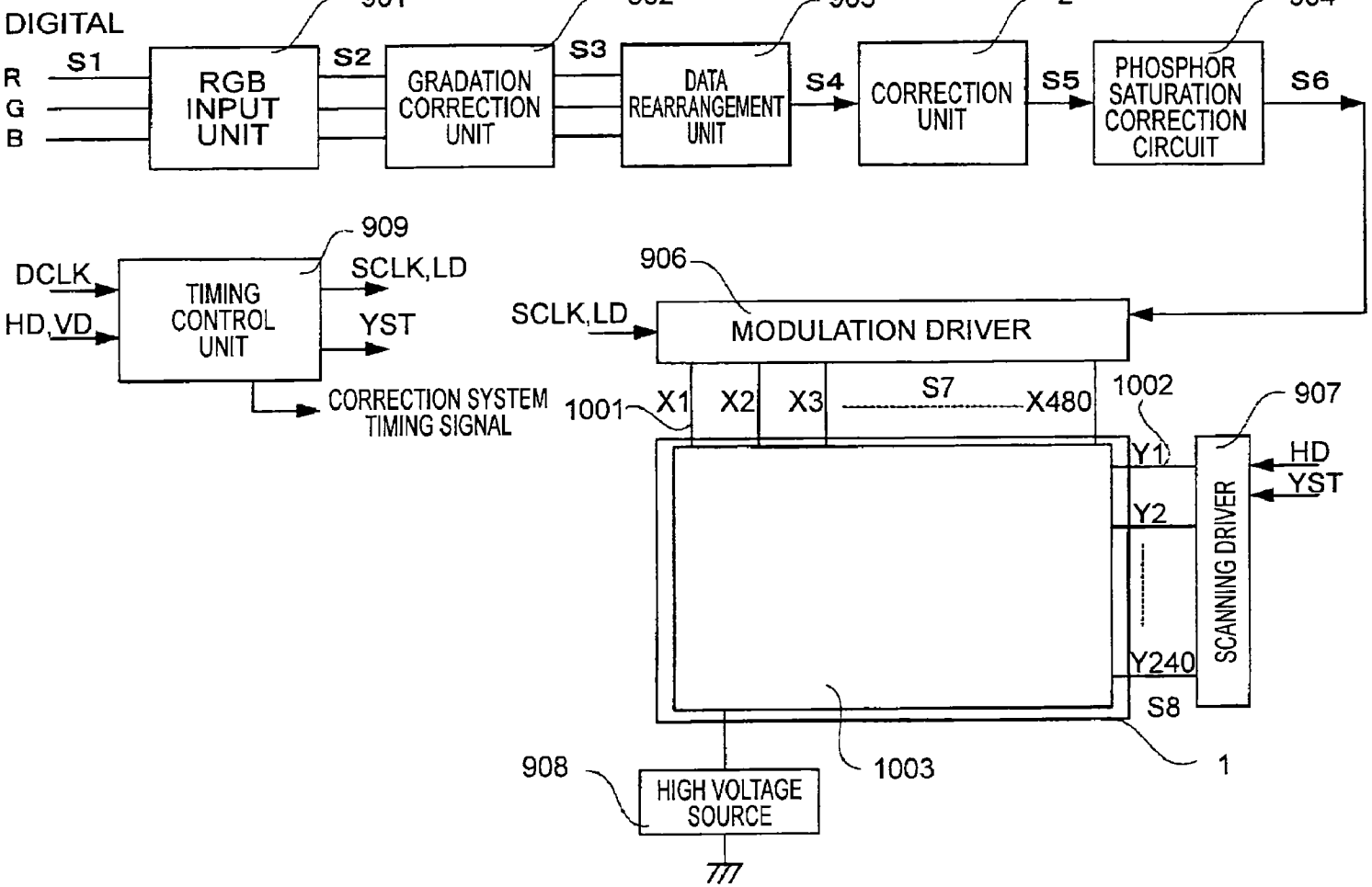
FIG. 2 is a block diagram showing the entire constitution of an image display apparatus.

FIG. 1 and FIG. 2 are views for explaining the first embodiment according to the present invention. FIG. 1 is a block diagram showing a correction unit of the present embodiment, and FIG. 2 is a block diagram showing the entire constitution of the image display apparatus according to the present embodiment.

At first, an entire flow of a signal will be described with reference to FIG. 2 showing the entire constitution of an image display apparatus according to the present embodiment, and then, the correction unit of the present embodiment for correcting the luminance unevenness will be described with reference to FIG. 1.

In FIG. 2, a reference numeral 1 denotes a matrix panel (a display panel) having a matrix wiring of 240 rows×480 (160×3 (RGB)) columns. A reference numeral 1001 denotes a modulation wiring, a reference numeral 1002 denotes a scan wiring, a reference numeral 1003 denotes a face plate to which a high voltage is applied, and a reference numeral 2 denotes a correction unit. A reference numeral 901 denotes an RGB input unit for receiving an image signal, and a reference numeral 902 denotes a gradation correction unit for cancelling a gamma of an image signal that is gamma-converted in order to cancel a characteristic of a CRT in advance. A reference numeral 903 denotes a data rearrangement unit for sequentially switching and outputting an RGB image of an image data to be inputted in an RGB parallel in response to the arrangement of an RGB phosphor of matrix panel, and a reference numeral 904 denotes a phosphor saturation correction circuit in order to correct a saturation characteristic of the phosphor. A reference numeral 906 denotes a modulation driver, a reference numeral 907 denotes a scanning driver, a reference numeral 908 denotes a high voltage source, and a reference numeral 909 denotes a timing control unit for outputting display timing and timing of a correction value or the like. The RGB input unit 901, the gradation correction unit 902, the data rearrangement unit 903, the correction unit 2, the phosphor saturation correction circuit 904, the modulation driver 906, the scanning driver 907, the high voltage source 908, and the timing control unit 909 may configure the drive circuit according to the present embodiment.

Figure 3:
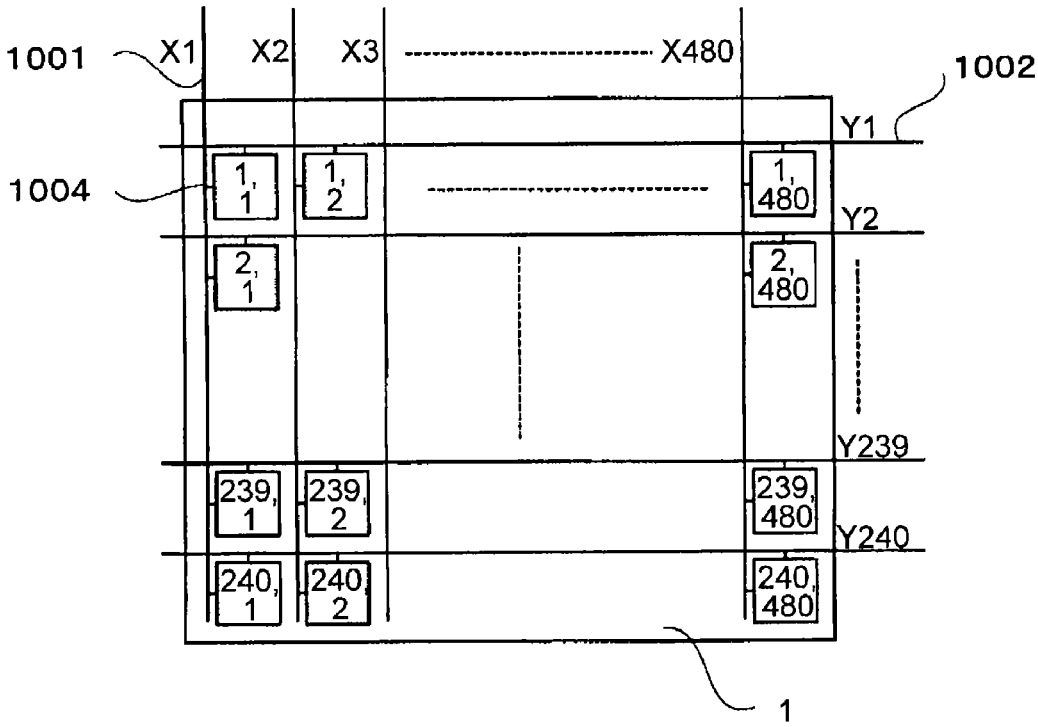
FIG. 3 is an explanatory view for explaining the constitution of a rear plate of a matrix panel.

FIG. 3 is a view schematically showing a rear plate of a matrix panel 1. In the matrix panel 1, the rear plate, a frame, and a face plate are bonded and the inside thereof is kept in a vacuum state. In FIG. 3, a reference numeral 1001 denotes a modulation wiring, a reference numeral 1002 denotes a scan wiring, and a reference numeral 1004 denotes an electron source that is represented by a surface conduction electron-emitting device, for example.

In FIG. 3, the frame of the face plate 1003 is omitted. Although it is not illustrated, the face plate 1003 is formed by a glass that is a base, a phosphor, and a metal back covering the phosphor. Strictly, the high voltage source 908 is supplied to the metal back of the face plate 1003. The electron emitted from the electron source 1004 is accelerated by a potential of the high voltage source 908 that is applied to the metal back. Then, the phosphor emits a light by the accelerated electron that passed through the metal back.

In the constitution of FIG. 2, in response to a horizontal synchronization signal of the image signal to be inputted, the scan wiring 1002 is sequentially selected. During this selection period, a predetermined selected potential is applied from the scanning driver 907 to the scan wiring 1002. On the other hand, a modulation signal in response to the luminance data corresponding to the selected scan wiring is applied from the modulation driver 906 to the modulation wiring 1001 during the selection period. By performing such selection for all the rows, after one vertical scanning period is terminated, an image on one screen is formed.

According to the present embodiment, the number of scan wirings is defined as 240; however, in the case of displaying the image by a standard TV signal such as an NTSC system, 480 pieces of the scan wirings are preferable. In the case of displaying a high-definition broadcast, 720 pieces (720 P) or 1,080 pieces (1,080 P) of the scan wirings is preferable. When the number of scan wiring of the inputted image as shown in the present embodiment is different from the number of the scan wirings, it is preferable to add up the number of scan lines of the image inputted by using a scaler or the like and the number of scan wirings. The scaler may be realized in the RGB input unit 901, for example.

According to the first embodiment of the present invention, the inputted digital component signal S1 is converted into the image signal having 240 pieces of scan lines by the scaler of the RGB input unit 901 (S2).

In the case that a digital component signal S2 that is inputted in the gradation correction unit 902 is a signal to which a gamma correction for cancelling a characteristic of a CRT has been applied in advance, the gradation correction unit 902 may perform reverse gamma correction in order to cancel this gamma characteristic. The gradation correction unit 902 can be easily realized by a table using a memory.

An output S3 of the gradation correction unit 902 is inputted in the data rearrangement unit 903. The data rearrangement unit 903 sequentially switches and outputs the RGB image data in response to an arrangement of a phosphor of a matrix panel (S4). Further, a signal (S4) is reverse-gamma-corrected by the gradation correction unit 902, so that the signal (S4) is the data proportional to the luminance (it is equivalent to "the driving data" and hereinafter, it is referred to as "luminance data"). Here, the data having the value proportional to the luminance to be obtained in practice is used as "the driving data"; however, upon practice of the present invention, this is not an essential requirement.

Luminance data (S4) is inputted in the correction unit 2 and as described later, this data is referred to as data (S5) that can correct the luminance variation (hereinafter, it is referred to as "correction luminance data"). This is equivalent to "the corrected driving data" according to the present invention. The correction luminance data (S5) is inputted in the phosphor saturation correction circuit 904. The phosphor saturation correction circuit 904 cancels a characteristic of a modulation output versus a luminance of the matrix panel 1 (a saturation characteristic of the phosphor or the like). The phosphor saturation correction circuit 904 corrects a saturation characteristic of the phosphor and nonlinearity of the modulation driver 906, and further, the phosphor saturation correction circuit 904 corrects the correction luminance data (S5) so that the selected display element emits a light at a luminance proportional to the inputted correction luminance data (S5). It is obviously preferable that each color, namely, R, G, and B has a different table when the saturation characteristic of the phosphor is different in each color, namely, R, G, and B.

The output of the phosphor saturation correction circuit 904 (S6) is inputted in the modulation driver 906 and a modulation signal for driving the modulation wiring is generated. The details of the modulation signal will be described later.

At the same time as the modulation driver 906 drives the modulation wiring 1001 at a modulation signal in response to the image, the scanning driver 907 outputs a selected potential to the corresponding scan wiring 1002. The electron source 1004 connected to the selected scan wiring 1002 and to the modulation wiring 1001, to which the modulation signal is applied, may emit an electron in accordance with the modulation signal of the modulation wiring 1001.

The high voltage source 908 is connected to a metal back of the face plate 1003 (not illustrated) so as to accelerate the emitted electron to be emitted from the electron source 1004. Then, the phosphor corresponding to each electron source 1004 emits a light by the accelerated emitted electron and then, this phosphor forms an image on the matrix panel.

<Correction Unit 2>

Next, a correction unit that preferably corrects the luminance variation of the display panel having the above-described constitution will be described below.

According to the first embodiment of the present invention, a plurality of correction values (for example, a correction value for a high luminance (equivalent to a second correction value) and a correction value for a low luminance (equivalent to a first correction value)) are used in response to the luminance for the same display element. As the embodiment of the present invention, the constitution such that the correction values are stored in response to all values of the driving data can be also adopted. However, since a capacity of a memory for storing the correction values is larger in such a case, according to the present embodiment, the correction values corresponding to some values (two values, namely, the first value and the second value according to the present embodiment) in the value of the driving data are stored. In the case that the value of the driving data inputted in the correction unit is different from these some values (the first value and the second value), interpolation processing is carried out by using a plurality of correction values that are stored, and a correction value to be used is generated. According to the present embodiment, correction is made by using a signal outputted from the circuit for carrying out this interpolation processing as a correction value. In order to simplify the explanation, the signal outputted from the circuit for carrying out the interpolation processing will be referred to as correction data below. In the case that the value of the driving data to be corrected has no necessity to use the correction value obtained by interpolation, the circuit for carrying out the interpolation processing outputs the correction value that has not been interpolated as it is. Accordingly, the value of the correction data may be a correction value that has not been interpolated or may be a correction value that has been interpolated. In the case of carrying out the interpolation processing, correction data is generated in accordance with the driving data (the luminance data). According to the present embodiment, an example to generate the correction data by interpolating based on two correction values will be described later. For a plurality of display elements, a plurality of correction tables including a correction table of a correction value for a high luminance and a correction table of a correction value for a low luminance are prepared. The correction table of the correction value for the low luminance is the information where the correction value for the low luminance corresponding to each display element (equivalent to the first correction value) is recorded so as to be capable of being read for each display element. The correction table of the correction value for the high luminance is the information where the correction value for the high luminance corresponding to each display element (equivalent to the second correction value) is recorded so as to be capable of being read for each display element.

FIG. 1 shows the constitution of the correction unit 2 according to the present embodiment.

The correction unit 2 includes a correction value output circuit 2001 and a correction circuit 2002. The correction value output circuit 2001 includes a memory U 201, a memory L 202, bit expanders 203 and 204, a linear interpolation circuit 205, a selector 206, and a decoder 207. The correction circuit 2002 is a circuit for carrying out correction on the basis of a correction value outputted from the correction value output circuit 2001.

<Characteristics of Display Element>

As a cause of luminance variation of the display element of the matrix panel 1, one due to the phosphor and one due to the electron source may be considered.

As a result of consideration by the inventors of the present invention, it has been found that a main cause of change of the luminance variation due to the display luminance is variation of a current emitted from the electron source.

Figure 4:
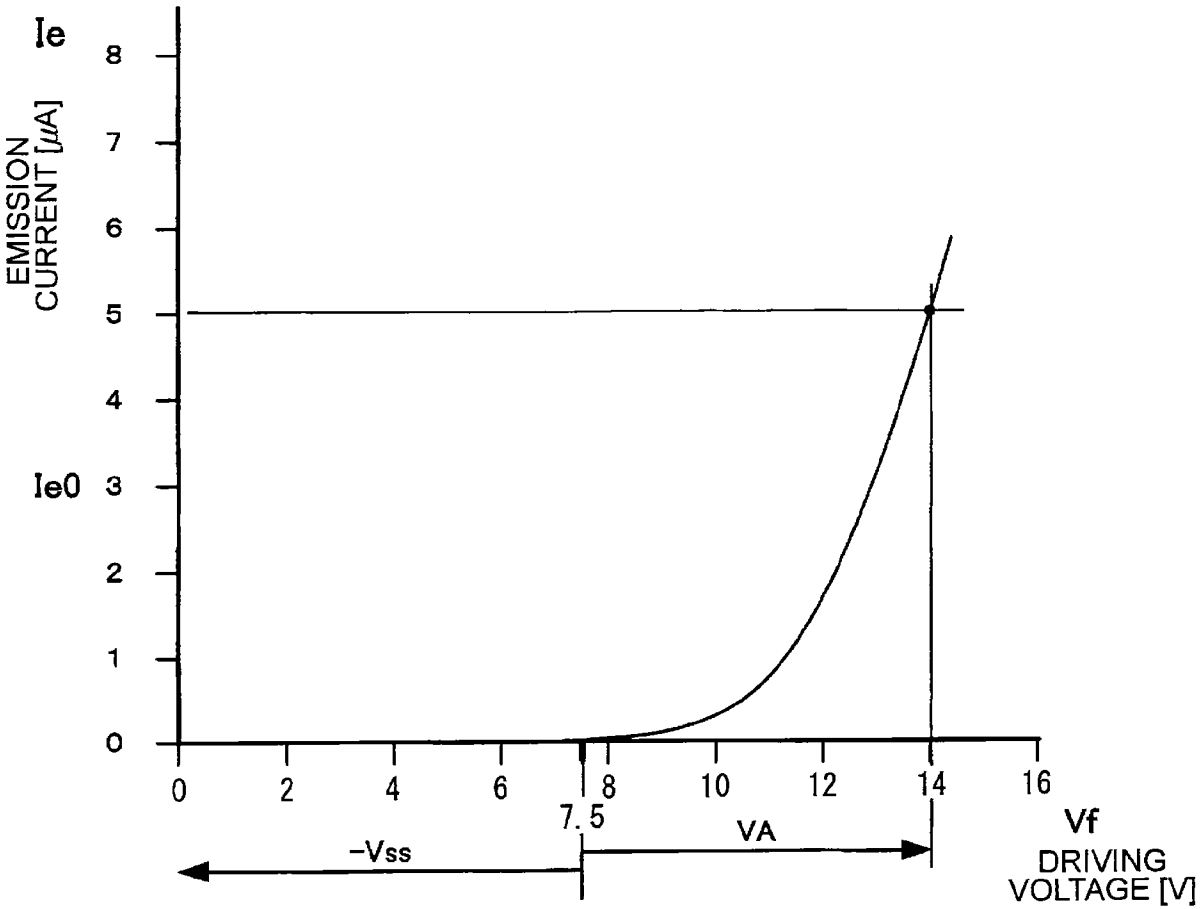
FIG. 4 is an explanatory view showing a characteristic of an electron source.

FIG. 4 illustrates a schematic graph of a driving voltage versus an emission current, which is a characteristic of the electron source 1004.

A lateral axis of FIG. 4 shows a driving voltage to be applied to the electron source 1004. In FIG. 4, an example that a selected potential (−Vss) selected by the scanning driver is determined as −7.5 V and the potential (VA) of the modulation signal of the modulation driver is determined as 7V is illustrated. When the electron source is selected, a driving voltage (Vf) where an absolute value of the selected potential is added to an absolute value of the modulation signal is applied to the electron source and the electron is emitted. On the other hand, it has been found that emission of the electron is not carried out when the selected potential or the modulation potential are only applied to the electron source.

Figure 5:
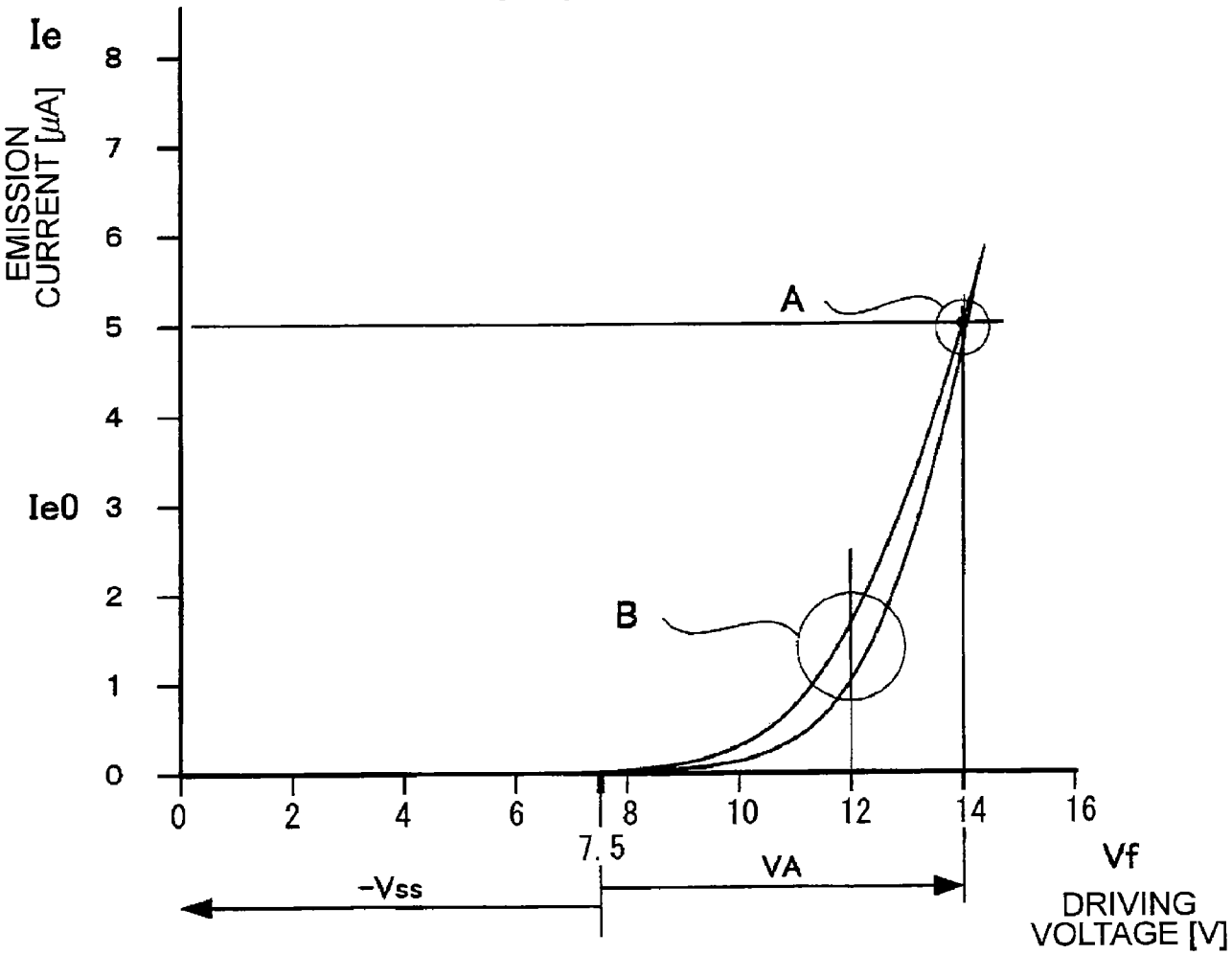
FIG. 5 is an explanatory view for showing an example of variation of a characteristic of an electron source.

The real matrix panel 1 has many variations of a characteristic of the electron source. FIG. 5 schematically illustrates properties of two electron sources as an example of variation of the characteristic of the electron source. In FIG. 5, A denotes a part where a potential of a modulation signal is high and values of emitted currents are relatively even. However, it is found that the values of the emitted currents are varied on the part denoted by B (the part where the potential of the modulation signal is low). Further, it is found that the voltages between A and B are varied though not to the extent of B. This variation of value of the emission current is a cause that the luminance variation of the display element is generated.

<Modulation Signal>

Next, an example of a modulation signal of the modulation driver 906 will be described. The electron source adopted in the present embodiment can control the emission current in response to the voltage, so that it is possible to change the luminance depending on voltage amplitude of the modulation signal. In addition, the luminance can be modulated by a pulse width of the modulation signal.

Figure 6:
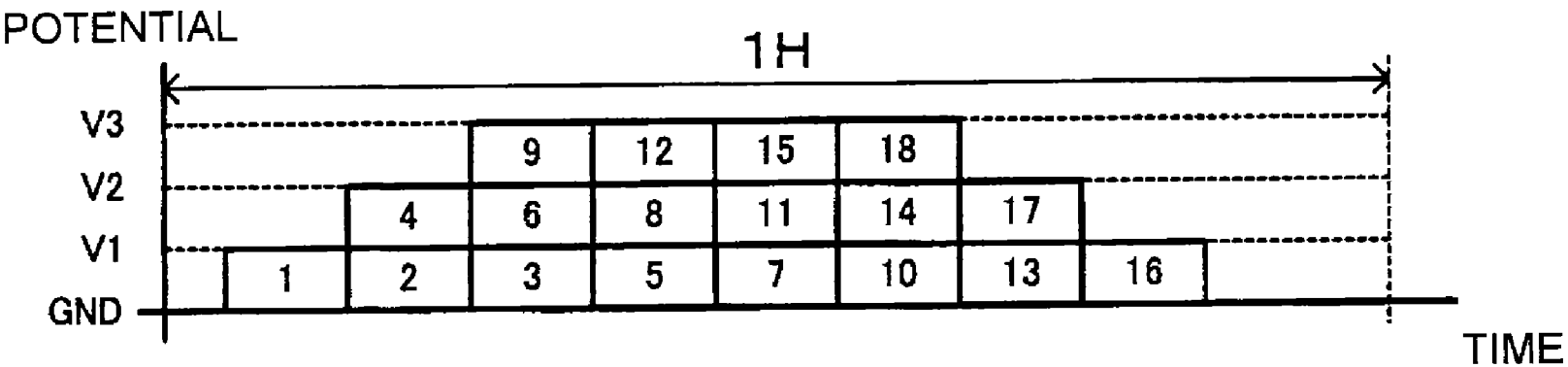
FIG. 6 is a view showing a modulation system.

The modulation signal may change the pulse width and the amplitude so as to allow the display element to emit a desired luminance. The inventors of the present invention drove the matrix panel in a system for modulating the pulse width and the amplitude by changing them, for example, as shown in FIG. 6. This modulation system is disclosed in JP-A No. 2004-219430. In FIG. 6, numerals in unit waveforms of the modulation signals (1 to 18) mean the values of the luminance data. When the luminance data is "5", for example, the waveforms corresponding to the numerals "1" to "5" in a rectangle are outputted as a modulation signal. In such a modulation system, by combining the pulse width with the amplitude, the smaller a difference between the adjacent gradation and luminance in the noticeable gradation is, the higher a gradation performance in the noticeable gradation is. As compared to a PWM modulation that the luminance is changed at an even pitch, the modulation system of the present system can increase the number of the gradations since the luminance difference in the adjacent gradations in the low luminance can be decreased when giving an attention to the low luminance. In the present modulation system, although the number of the gradations can be increased by modulating the amplitude direction, the operating voltage of the device may be lower than that of a normal PWM. As a result, the luminance variation of the display element is made larger at the low luminance. According to the example shown in FIG. 6, the number of the amplitude potential is three (V1, V2, and V3) and the division number of a time direction is 8, however, in accordance to the necessary number of the gradations, the number of the amplitude potentials and the division number of the time direction to determine a unit waveform may be determined.

However, even in the constitution to carry out modulation only by the amplitude, as represented by B of FIG. 5, the luminance is varied since the properties of respective electron source are different and the luminance is differently varied in a high gradation area and a low gradation area. Therefore, the present invention can be applied.

In addition, even in the case of carrying out modulation only by a pulse width, if the luminance is differently varied in the high gradation area and the low gradation area, the present invention can be applied.

<Distribution of Luminance Variation>

Figure 7A:
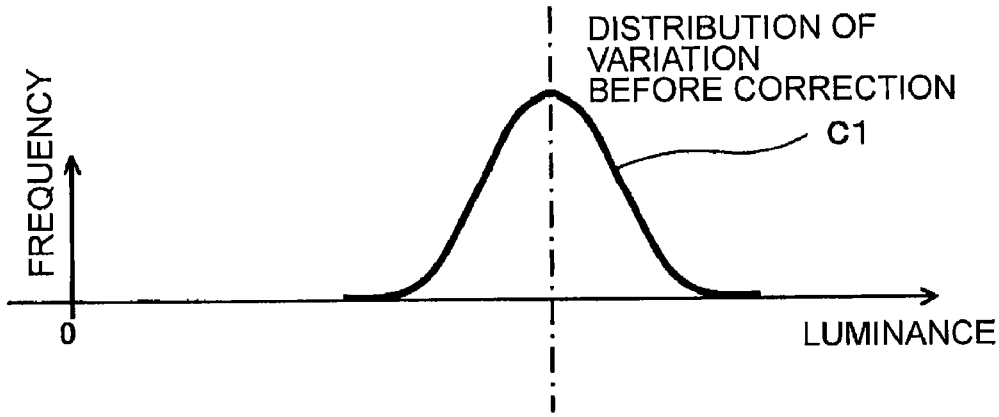
FIG. 7A is an explanatory view showing distribution of variation of a luminance before correction when the luminance is high.
Figure 7B:
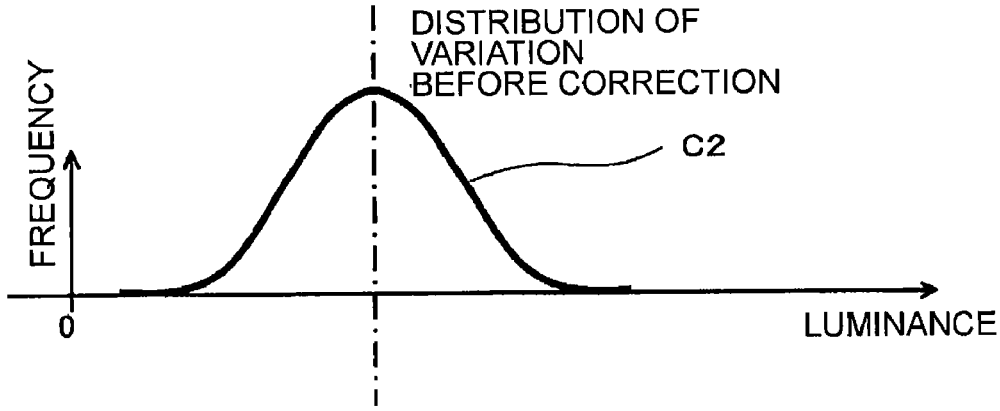
FIG. 7B is an explanatory view showing distribution of variation of a luminance before correction when the luminance is low.

When the matrix panel provided with the electron source as shown in FIG. 5 is driven by a modulation signal shown in FIG. 6, it is found that the distribution luminance variation as shown in FIG. 7A and FIG. 7B is generated depending on the luminance.

FIG. 7A and FIG. 7B illustrate a histogram where a lateral axis represents a luminance of the display element and a longitudinal axis represents the number of the display elements (the number of pixels) at the corresponding luminance. This histogram shows a distribution of variation of a luminance in the case that correction by the correction unit 2 is not carried out (hereinafter, it may be also referred to as "a distribution of luminance variation before correction"). FIG. 7A and FIG. 7B illustrate the distribution of the variation while normalizing it. FIG. 7A and FIG. 7B illustrate the luminance variation of each display element when predetermined data (for example, the luminance data "100" and "4000") is inputted (for example, in the case of the luminance data "100" (the first value), the luminance variation is as shown in FIG. 7B, and in the case of the luminance data "4000" (the second value), the luminance variation is as shown in FIG. 7A)).

According to the present embodiment, the bit width of the luminance data is 12 bits and the value of the luminance data is in the range of 0 to 4095 in a decimal number. According to the present embodiment, the luminance data after correction is also outputted at 12 bits.

Here, when correcting the variation of brightness of each pixel in the case that the value of the luminance data is 4000, an appropriate reference value (equivalent to the second brightness) is determined on the lateral axis of FIG. 7A, which is a frequency distribution chart. With respect to the pixel that is brighter than the reference value, when the value of the luminance data is 4000, the correction to reduce the brightness is carried out, and this intends to bring the brightness close to the reference value. In addition, with respect to a pixel that is darker than the reference value, when the value of the luminance data is 4000, it is possible to bring the brightness close to the reference value by carrying out the correction to intensify the brightness. However, overflow may be generated if the correction to intensify the brightness is carried out. For example, in the case of the range of the value that can be inputted in the circuit at the next stage of the correction circuit (here, the phosphor saturation correction circuit 904) is within 0 to 4095, the case that the value of the driving data to be corrected is 4000 and correction is carried out by multiplication defining the correction value as a gain will be considered below. In this case, if the correction value is more than 1.02375, overflow is generated.

On the other hand, when correcting variation of the brightness of each pixel in the case that the value of the luminance data is 100, an appropriate reference value (equivalent to the first brightness) is determined on the lateral axis of FIG. 7B, which is a frequency distribution chart. With respect to the pixel that is brighter than the reference value, when the value of the luminance data is 100, the correction to reduce the brightness is carried out, and this intends to bring the brightness close to the reference value. In addition, with respect to a pixel that is darker than the reference value, when the value of the luminance data is 100, it is possible to bring the brightness close to the reference value by carrying out the correction to intensify the brightness. However, overflow is not easily generated even if the correction value is large differently from the case that the value of the luminance data is 4000, which is the value on the side of the high gradation.

Therefore, with respect to the correction value on the side of the high gradation, reference brightness (the second brightness) is determined on the portion where the brightness is sufficiently low within the range of bright distribution on the frequency distribution chart. Thereby, it is possible to reduce the number of pixels that are not brought close to the reference brightness (the second brightness) unless they are corrected into a direction to make the image brighter (namely, the pixels that may be overflowed). The pixels that are brighter than the reference brightness are corrected so as to be brought close to the reference brightness. The pixels that are darker than the reference brightness may be corrected so as to be brought close to the reference brightness although they may be overflowed or they may be corrected so as not to be brought close to the reference brightness in order to further prevent a possibility of overflow.

On the other hand, since the correction value on the side of the luminance has a low possibility of overflow from the beginning, there is not so much necessity to decrease the number of the pixels that are not brought close to the first brightness, which is the reference brightness, unless it is corrected into a direction to make the image bright. In other words, many pixels to be corrected into a direction to make the image bright are allowed. If there are many pixels in the direction to make the image dark, a screen is easily made dark; however, by increasing the number of pixels to be corrected into a direction to make the image bright, it is possible to prevent brightness of the entire screen from being lowered.

Therefore, the first brightness, which is the first brightness as the reference brightness for determining the correction value on the side of the low luminance is determined so that the following conditions are satisfied.

The number of the pixels that are darker than the first brightness on the frequency distribution chart on the side of the low gradation is more than the number of the pixels that are darker than the second brightness on the frequency distribution chart on the side of the high gradation (the number thereof is sometimes 0).

By determining the correction value on the basis of the first brightness and the second brightness that are determined in this way, respectively, it is possible to reduce unevenness of brightness while preventing overflow and it is also possible to prevent the screen from being darker.

Further, the distribution shown in FIG. 7A and FIG. 7B is an example. In the image display apparatus using the electron-emitting device, a half-value width of the variation distribution of the low luminance tends to be wider than the half-value width of the variation distribution of the high luminance. In other words, the half-value width of the frequency distribution chart (for example, C1 of FIG. 7A) where the lateral axis represents brightness and the longitudinal axis represents the number of pixels when the brightness is measured by driving the pixel by the driving data having the first value (for example, 100) without correction by means of the correction circuit 2002 tends to be larger than the half-value width of the frequency distribution chart (for example, C2 of FIG. 7B) where the lateral axis represents brightness and the longitudinal axis represents the number of pixels when the brightness is measured by driving the pixel by the driving data having the second value (for example, 4000) without correction by means of the correction circuit 2002. The correction of the luminance variation according to the present embodiment is effective for the image display apparatus including the pixel having such a tendency. Particularly, this tendency is remarkable in the case that the electron-emitting device is an electron-emitting device using a carbon and a carbon composition such as a carbon nano tube and a graphite nano fiber for an emission unit and the electron-emitting device is a surface conduction electron-emitting device.

In addition, the distribution of variation has the possibility of also depending on a waveform of a modulation signal. According to the present embodiment, when the luminance is high, there are many parts where the potential is high in the modulation signal. For example, the voltage represented by A of FIG. 5 has been applied for a long period of time, so that variation of the emission current is relatively small. Therefore, the distribution of the luminance variation as represented by a curve C1 shown in FIG. 7A is obtained and variation of the luminance is relatively small. On the other hand, when the luminance is low (for example, a signal inputted in a modulation driver is 1, 2, and 3 or the like), since the modulation signal has many parts where the potential is low, the low voltage represented by B of FIG. 5 is applied, so that variation of the emission current is relatively large.

<Decision of Correction Value>

Figure 18:
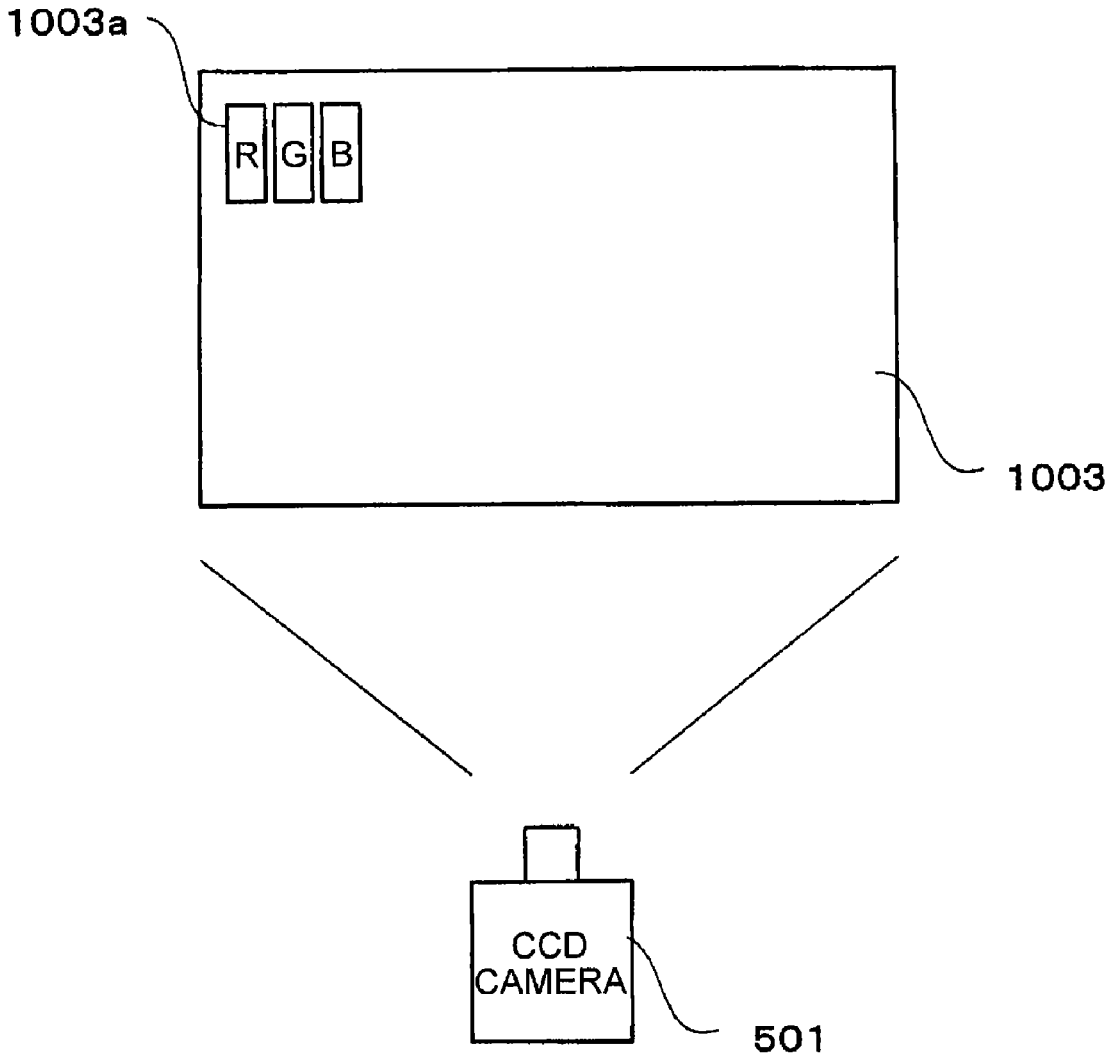
FIG. 18 is an explanatory view showing luminance measurement.

By measuring the luminance of each pixel and dividing a target luminance (the first brightness or the second brightness) by the measured luminance, it is possible to obtain a correction value for preventing variation. Then, by multiplying the luminance data by the correction value, the correction luminance data can be obtained. The luminance measurement by means of a CMOS camera and a CCD camera 501 or the like as shown in FIG. 18 is preferable because the luminance data of many display elements can be obtained at the same time. A reference numeral 1003*a* denotes a display area of a display element of the face plate 1003. When carrying out the luminance measurement, bit correction is not carried out but the matrix panel 1 is driven.

<Correction Unit 2>

FIG. 1 shows the constitution of the correction unit 2 according to the present embodiment. With reference to FIG. 1, the correction unit according to the first embodiment of the present invention will be described below.

FIG. 1 shows the constitution having two correction values for the high luminance and the low luminance. Three or more correction values can be realized as well as this. In order to simplify the explanation, the constitution of FIG. 1 having two correction values for the high luminance and the low luminance will be described. The correction values to the number of the display elements for a certain gradation are referred to as "a correction data set (a correction table)". FIG. 11A and FIG. 11B show an example of a table representing the luminance of each display element when the high luminance data (4000) and the low luminance data (100) are inputted, respectively. FIG. 12A and FIG. 12B show a correction data set in the high luminance and the low luminance obtained from the luminance variation shown in FIG. 11A and FIG. 11B, respectively. The brightness (namely, the first brightness) that is a reference in the low luminance data (its value is 100) is 7.0 cd/m$^2$. The brightness (namely, the second brightness) that is a reference in the high luminance data (its value is 4000) is 280 cd/m$^2$.

The correction unit 2 is provided with the correction value output circuit 2001 for outputting the correction value, and the correction value output circuit 2001 is configured by the memory U 201 and the memory L 202 or the like. The memory U 201 is a memory for storing the corrected data set (the correction table) for the high luminance when displaying the high luminance, and the memory L 202 is a memory for storing the correction data set (the correction table) for the low luminance when displaying the low luminance. The correction circuit 2002 has a multiplier 208 for calculating the correction value (the correction data) and the luminance data that is the driving data. According to the present embodiment, in the correction value output circuit 2001, without using the correction values outputted from the memory U 201 and the memory L 202 as they are, these correction values are used after carrying out the bit number adjustment processing and the interpolation processing. The correction value output circuit 2001 has a circuit for carrying out the bit number adjustment processing and a circuit for carrying out the interpolation processing. The bit number adjustment processing circuit has bit expanders 203 and 204, and the interpolation processing circuit has the linear interpolation circuit 205, the selector 206, and the decoder 207.

The correction value for the high luminance can be obtained by dividing the second brightness as a reference by brightness of each pixel that is actually measured. The memory U 201 stores the portion not more than an arithmetic point within a correction value (a value of 9 bits, M=9) that is obtained in this way. According to the present embodiment, in order to prevent overflow, a value less than 1 is only used as a correction value for a high luminance. Consequently a value of an integer portion of the correction value is 0 and there is no necessity to store the integer portion. Therefore, the memory U 201 stores 8 bits (N=8) of an arithmetic point portion within the correction value of 9 bits. In order to output the correction value that can be used for multiplication, the bit expander 203 adds 0 as the most significant bit to the correction value to be outputted by the memory U 201. However, according to the present embodiment, a configuration allowing that the high luminance are has one or more correction values as a correction value for a very dark display element for the reference bright can be also adopted. In this case, the integer portion may be also stored in the memory 201. In the correction according to the present embodiment, the number of the display elements that are corrected to be made dark in the high luminance area (the side of the high gradation) is more than that in the low luminance area (the side of the low gradation). However, it is not necessary to carry out correction to make the entire display elements dark in the high luminance area (the correction value is less than 1).

On the other hand, in order to prevent the image from being displayed dark, the side of the luminance allows one or more correction values. Accordingly, the most significant bit of the correction value can be 1. Therefore, the most significant bit of the correction value (9 bits) for the low luminance is also recorded in the memory. According to the present embodiment, 8 bits (P=8) from the most significant bit among the correction values of 9 bits as the correction value are recorded in the memory L 202. Upon using the correction value, in order to return the correction value to that of 9 bits (Q=9), the bit expander 204 adds 0 as the least significant bit.

Further, according to the present embodiment, a value obtained by the driving data to be inputted in the correction unit 2 is within the range of 0 to 4095, and a value obtained by the corrected driving data to be outputted from the correction unit 2 is within the range of 0 to 4095, so that they are in the same range. Accordingly, the case that the correction value for correcting the bright variation is more than 1 corresponds to correction about the direction to make the image bright and the case that the correction value for correcting the bright variation is smaller than 1 corresponds to correction about the direction to make the image dark. However, the present embodiment is not limited to this constitution. For example, the constitution that the range of the inputted value and the range of the outputted value are different such that the value of the driving data to be inputted in the correction unit 2 is within the range of 0 to 4095 and the value of the corrected driving data to be outputted from the correction unit 2 is within the range of 0 to 8190 can be also adopted. In this case, the case that the correction value is larger than 2 corresponds to correction about the direction to make the image bright and the case that the correction value for correcting the bright variation is smaller than 2 corresponds to correction about the direction to make the image dark. In this case, the state that correction due to this correction circuit is not carried out corresponds to multiplication of each driving data by 2 without exception.

Figure 8:
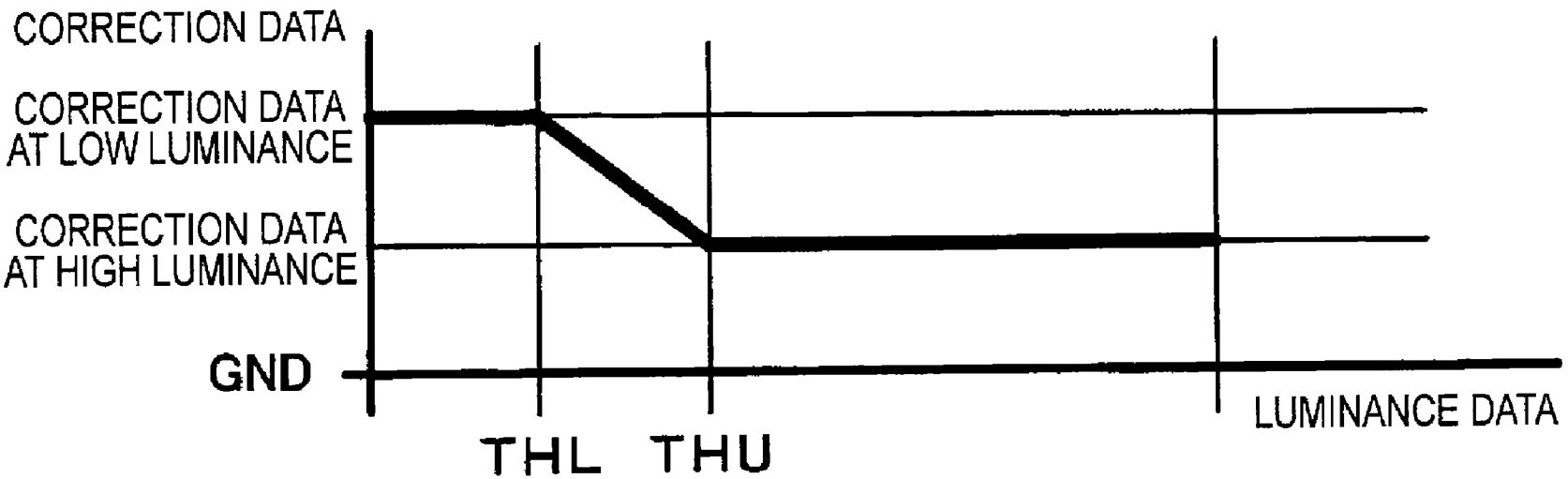
FIG. 8 is an explanatory view showing a relation between the corrected data and the luminance data.

A decoder 207 may compare a threshold value THL, THU that is determined in advance with the luminance data to be inputted (S4). The linear interpolation circuit 205 linearly interpolates the value of the bit expander 203 and the value of the bit expander 204 by the value of the luminance data (S4) between the threshold value THL and THU. A reference numeral 206 denotes a selector and the selector 206 selects an A terminal when the luminance data (S4) to be inputted is not less than the threshold value THU, selects a B terminal when the luminance data (S4) is not less than the threshold value THL and less than THU, and selects a C terminal when the luminance data (S4) is less than the threshold value THL. Output of the bit expander 203 is connected to the A terminal, output of the linear interpolation circuit 205 is connected to the B terminal, and output of the bit expander 204 is connected to the C terminal, respectively. A reference numeral 208 denotes a multiplier and the multiplier 208 forms correction luminance data (S5) by multiplying the correction value (the correction data: S10) outputted from the selector 206 and the luminance data (S4). FIG. 8 shows a relation between the correction value (the correction data: S10) outputted from the selector 206 and the luminance data with respect to a certain display element. For example, by linearly interpolating a space between two correction values of the correction data set of FIG. 12A and FIG. 12B (they are two correction values corresponding to the same pixel, here, "0.70" for the high luminance and "1.00" for the low luminance), the correction data for the luminance data between the threshold value THL and THU is obtained. Due to this interpolation, by using the correction value when the value of the luminance data is 100 and the correction value when the value of the luminance data is 4000, it is possible to generate a correction value that is used when the luminance data has the value other than 100 and 4000. Then, it is possible to continuously form a correction value for the luminance data between the threshold value THL and the threshold value THU. In FIG. 8, a lateral axis represents a value of the luminance data (S4) and a longitudinal axis represents a value of the correction data (S10) outputted by the selector 206, respectively. "The low luminance correction data" of the longitudinal axis shows the value of the bit expander 204 (the correction value of the correction data set for the low luminance) and "the high luminance correction data" of the longitudinal axis shows the value of the bit expander 203 (the correction value of the correction data set for the high luminance). Between the threshold values THL and THU, the correction data to be interpolated is prevented from being discontinuous by the luminance. If the correction data (S10) outputted from the selector 206 is discontinuous to the luminance data (S4), the correction luminance data (S5) is also discontinuous to the luminance data (S4) to be inputted. As a result, the luminance is also discontinuous and a quality level of the display image is lowered.

In addition, it is preferable that the values of the threshold values THL and THU are changed depending on a modulation system and a parameter thereof. Further, it is not necessary to conform the threshold value THL with the value of the driving data when the distribution of brightness on the side of the low luminance is obtained (according to the present embodiment, 100). In addition, it is not necessary to conform the threshold value THU with the value of the driving data when the distribution of brightness on the side of the high luminance is obtained (according to the present embodiment, 4000). For example, in the case that the number of the amplitude potentials of the modulation system described in the first embodiment (FIG. 6) is 3, and the division number of the time direction is 255, the modulation signals having different waveforms can be generated when the value of the driving data to be outputted from the phosphor saturation correction circuit 904 is within the range of 0 to 759. Accordingly, the range of the value of the driving data to be inputted in the phosphor saturation correction circuit 904 is 0 to 4095. In contrast, the range of the value of the driving data to be outputted from the phosphor saturation correction circuit 904 is 0 to 759. In addition, the phosphor saturation correction circuit 904 is a circuit serving to carry out nonlinear conversion. As being obvious from FIG. 6, in the range that the value of the driving data to be inputted in the modulation driver is 1 to 8, there is no part where the highest potential V3 is found in the waveform of the modulation signal. In consideration of a difference in the ranges of the values of the inputted data and the outputted data and the nonlinear conversion by the phosphor saturation correction circuit, the value of the driving data to be inputted in the modulation driver becomes about 8 when the value of the driving data (the luminance data) to be inputted in the correction unit 2 is about 80. Therefore, according to the present embodiment, THL is defined to be 80.

On the other hand, as being known from the driving waveform shown in FIG. 6, if the value of the driving data to be inputted in the modulation driver becomes about 100, the time of V3 becomes dominant (about 90%). A degree of incidence of the luminance when the pixel is driven at V1 and V2 is not more than 10% from a characteristic of the emission current of the electron source 1004, so that it is possible to reduce the incidence of the luminance when the pixel is driven at V1 and V2 to 10% or less if the value of the driving data to be inputted in the modulation driver is not less than 100. In other words, the luminance when the pixel is driven at V3 becomes dominant. Therefore, it is preferable that a fixed correction data, namely, "the high luminance correction data" is used when the value of the driving data to be inputted in the modulation driver is not less than 100. Specifically, THU is defined to be 320 in consideration of a difference in the ranges of the values of the inputted data and the outputted data and a nonlinear conversion due to the phosphor saturation correction circuit.

Figure 9:
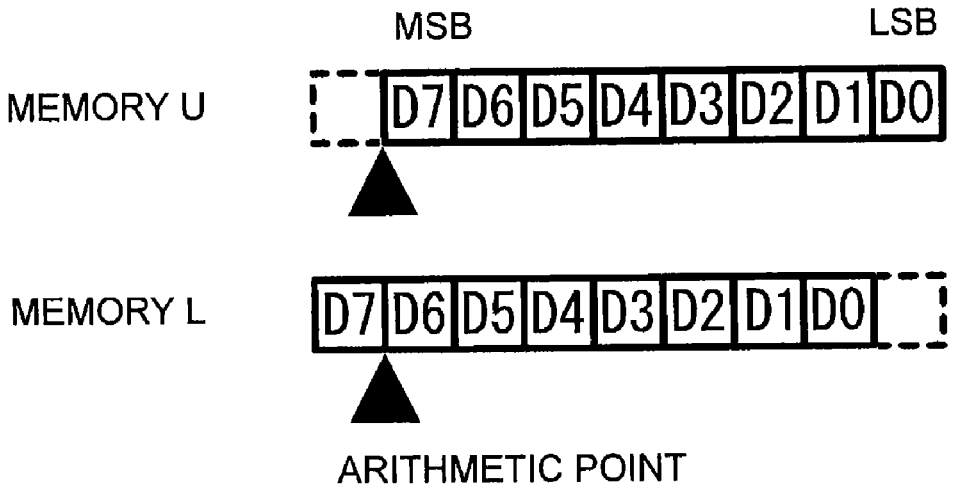
FIG. 9 is an explanatory view showing an example of a data storage method of a memory 201 and a memory 202.

FIG. 9 shows an example of a data storage method of the memory U 201 and the memory L 2. The capacity of the memory is directly linked with a cost of hardware. By making the luminance correction value when displaying the image at the high luminance into a value less than 1, the portion not more than the arithmetic point portion may be only stored. Thereby, it is possible to reduce the capacity required by the memory U 201 for storing the data set. In addition, by making the luminance correction value when displaying the image at the low luminance into a value less than 2, it is possible to make an integer portion to be stored into 1 bit. Thereby, it is possible to reduce the capacity required by the memory L 202.

The luminance correction data set upon display at the high luminance is decided by displaying the panel at a relatively high luminance (it displays the image so that the light emission at the modulation potential V3 is mainly dominant), measuring the luminance, and dividing the reference value by the measured luminance. The luminance correction data set upon display at the low luminance is decided in the same way by displaying the panel at the relatively low luminance (it displays the image so that the light emission at the modulation potential V2 or V1 is mainly dominant). FIGS. 12A and 12B show the examples of the high luminance correction data set and the low luminance correction data set.

Here, correction of the present embodiment is characterized by where the reference value of brightness when deciding these correction values (the target values of FIG. 10A and FIG. 10B) is located in the distribution. According to the example shown in FIG. 10A, the target value (the second brightness) is set at an average value $-3\sigma$. Thereby, assuming that the variation distribution before correction is a normal distribution, 99% or more of the luminance data on the side of the high luminance is corrected into a direction to make the image darker by the correction data. In this case, the value of the correction data in order to correct the average value of the luminance on the side of the high luminance into the target value is "0.73". Then, according to the present embodiment, the reference value is determined so that the value obtained by multiplying the average value of the luminance on the side of the low luminance by 0.73 becomes the reference value on the side of the low luminance (the first brightness). In other words, the reference value is determined so that the value obtained by dividing the second brightness by the average value on the side of the high luminance is equal to the value obtained by dividing the first brightness by the average value on the side of the low luminance. Further, on the side of the low luminance, a value not less than 1 is allowed as the value of the correction data.

By setting the reference value in this way, the correction can be made so that the number of the display elements corrected so as to be dark when the luminance data on the side of the low luminance (the first luminance data) is inputted for a plurality of display elements is smaller than the number of the display elements corrected so as to be dark when the luminance data (the second luminance data) located on the higher gradation side than the first luminance data is inputted for the plurality of the display elements. Since correction so as to make the luminance data of the pixel having the smaller luminance than the reference value is allowed in the first luminance data, it is possible to reduce the luminance unevenness while preventing the image from being darker.

In addition, by setting the reference value of brightness (the target value in FIG. 10A) for deciding the correction value of the high luminance area at the portion where brightness is low to some extent within the range of the bright distribution C1, it is possible to reduce possibilities that the luminance data exceeds the upper limit by correction, and generation of overflow can be reduced because the correction values of most pixels become those in a direction to reduce the data.

On the other hand, in the low luminance area, overflow due to making the data larger by correction does not likely occur, so that the correction value to make the data larger is allowed. Thereby, remains of correction can be reduced.

According to the above-described method, correction of variation is preferably available. Particularly, the matrix panel having the luminance variation distribution as shown in FIG. 7A and FIG. 7B can be preferably corrected by giving the luminance correction data sets at the high luminance and the low luminance. In addition, making the data by interpolating the correction data at the high luminance and the low luminance, it is possible to correct the bit well even at the luminance other than that obtained the luminance correction data set.

Further, as shown in FIG. 5, in the matrix panel that the luminance variation is made larger at the low luminance, by making the value of the data of the luminance correction data set not less than 1 when displaying the low luminance, the correction range can be made larger, so that correction can be preferably made. This will be specifically described below.

Figure 10A:
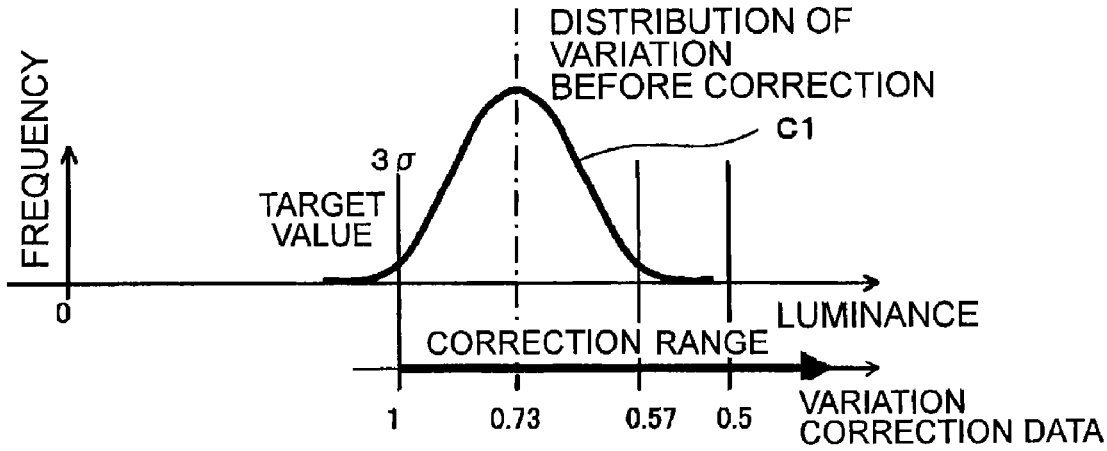
FIG. 10A is an explanatory view showing distribution of the variation of the luminance before correction and a correction range when the luminance is high.
Figure 10B:
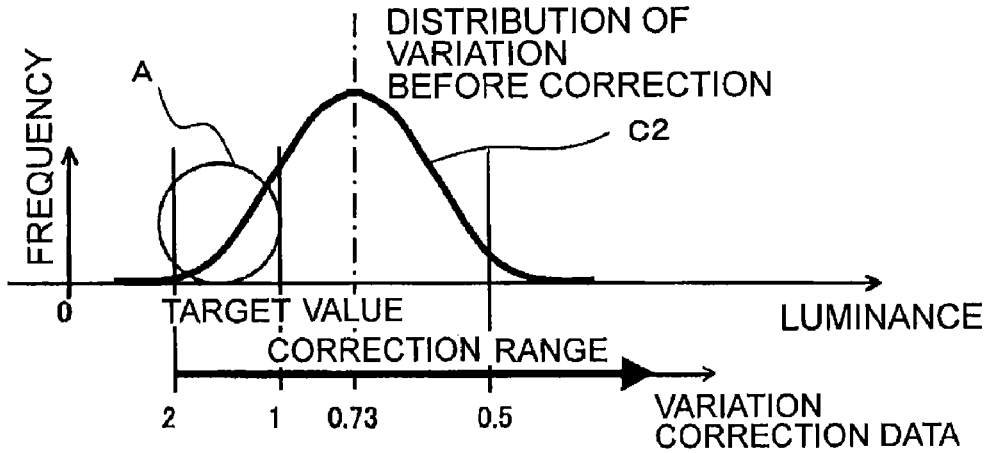
FIG. 10B is an explanatory view showing distribution of the variation of the luminance before correction and a correction range when the luminance is low.

FIG. 10A and FIG. 10B show the luminance variation distribution before correction and the correction range.

FIG. 10A is a view showing the luminance variation distribution upon display at the high luminance before correction and the correction range. From the luminance variation distribution upon display at the high luminance before correction, for example, the luminance that is lower than the average by $3\sigma$ luminance is defined as a luminance target value (namely, the second brightness that is a reference). For example, the luminance target value is defined to be 73% of the average value of the luminance variation distribution upon display at the high luminance before correction. Obviously, the numeric value is merely an example and this may be determined from the specification of the luminance unevenness of the image display apparatus and the luminance variation distribution before correction. The correction range represented by a bold line in FIG. 10A is a correction range and this represents the value of the correction data set. The luminance lower than the target value is not defined to be a target of the variation correction according to this embodiment. Next, the luminance variation distribution upon display at the low luminance before correction and the correction range are shown in FIG. 10B. It is better that the luminance target value (the first brightness that is a reference) may be in the range of the average to the same ratio as that upon display at the high luminance, namely, the luminance of 73%. This makes it easy to keep a linearity of a gradation characteristic. Upon display at the low luminance, as compared to display at the high luminance, the luminance variation distribution before correction is made larger. Since the luminance target value upon display at the low luminance is the same ratio as that upon display at the high luminance, the value of the correction data set for correction of the part represented by A of FIG. 10B is required to be 1 or more. According to the present embodiment, the correction data set upon the low luminance is set so as to be 1 or more, so that the correction on the part represented by A of FIG. 10B can be made. The correction range represented by a bold line of FIG. 10B is a correction range and it shows the value of the correction data set. In other words, the display element that does not reach the target luminance upon display at the low luminance is transmitted to a circuit at a next stage while forming correction luminance data S5 having a value larger than luminance data S4 by defining the value of the correction data set to be 1 or more. Then, the and drive a matrix panel so as to be capable of carrying out the correction so as to bring the luminance close to a target luminance. In addition, the display element at the luminance beyond the correction range is not corrected.

According to the first embodiment, a value not less than 1 is also available only for the luminance correction data set upon display at the low luminance because the luminance data S4 upon display at the low luminance is small and the luminance data S4 does not exceed the upper limit of the correction luminance data S5 even if correction data S10 not less than 1 is multiplied. Therefore, without overflow of the correction luminance data, it is possible to correct the variation well.

In addition, a circuit formed by the linear interpolation circuit 205, the selector 206, and the decoder 207 may be realized by a table circuit or the like, which continuously changes the outputs of the bit expanders 203 and 204 against the luminance data (S4).

On the other hand, a method of setting a luminance that is lower than the average of the luminance variation distribution upon display at the low luminance before correction by 3*a* luminance at a luminance target value as same as the above-described method may be considered. In this case, remains of correction is small and the correction upon display at the high luminance is also available, however, as compared to the method of setting the target luminance from the above-described case upon display at the high luminance, the luminance is lowered on the side of the low luminance.

As described above, according to the first embodiment of the present invention, the luminance variation can be corrected well even at the low luminance or the high luminance. Then, it is possible to realize an image display apparatus having luminance unevenness reduced.

Second Embodiment

As a second embodiment of the present invention, various modified examples will be shown. The constitutions of the image display apparatus according to these modified examples are the same as the constitution of the first embodiment (FIG. 2). The parts different from the first embodiment will be described below.

<Characteristic of Display Element>

According to the first embodiment, as a cause of the luminance variation of the display element, an example due to an electron source is cited. As a result of further consideration by the present inventors, the luminance variation is changed depending on the display luminance due to saturation of the phosphor in many cases. The phosphor may emit a light by an electron to be inputted. The light emission luminance of the phosphor is saturated for incidence of the electron, so that the variation of the luminance is compressed at the high luminance area. As a result, the luminance variation upon display at the low luminance is made larger.

Even if the luminance variation is different in the low luminance area and the high luminance area because of saturation of the phosphor, due to the correction described in the first embodiment, the luminance unevenness of the image display apparatus can be corrected well.

<Modulation Signal>

Other embodiments of the modulation signal of the modulation driver 906 will be described below. The electron source that is adopted according to the present embodiment (the electron-emitting device) is an electron source that can control the emission current in response to the voltage as same as the first embodiment. This kind of electron source can change a luminance due to the voltage amplitude and further, this kind of electron source can modulate the luminance depending on a pulse width.

Also in the image display apparatus in the following modulation system, by applying the correction described in the first embodiment, it is possible to correct the variation of the luminance well.

(1) Pulse Width Modulation with Slew Rate Control

Figure 13:
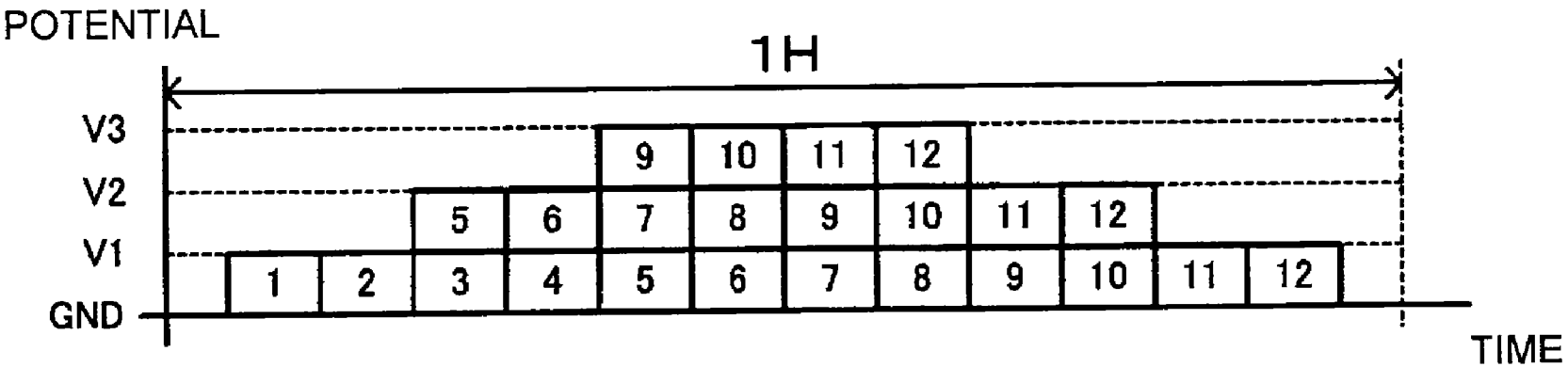
FIG. 13 is an explanatory view showing an example of a modulation signal.

A preferable example of the modulation signal according to the present invention is shown in FIG. 13. As same as the first embodiment, the numerals in unit waveforms (1 to 12) mean the values of the luminance data, and for example, when the luminance data is "5", waveforms corresponding to the numerals "1" to "5" in the rectangular are outputted as a modulation signal. In other words, a unit waveform corresponding to a numeral not more than the value of the signal (S6) to be inputted in the modulation driver 906 is outputted. In the present modulation system, the pulse width is increased in accordance with the value of the signal (S6) to be inputted in the modulation driver 906 and the potential is shifted to a larger amplitude potential when two unit times are secured for rising and falling. Also in this modulation system, the amplitude potential of the modulation signal upon display at the low luminance is made smaller, so that the luminance variation is made larger on the basis of the characteristic of the electron source shown in FIG. 5. Therefore, by applying the correction according to the present invention, it is possible to display the image having the reduced luminance variation and a high linearity.

The waveform shown in FIG. 13 is simplified for the explanation of the embodiment. The number of unit times and the number of amplitude potentials of the modulation signal necessary for real rising and falling may be determined depending on the required specification of the number of gradations or the like.

The correction having two correction data sets for high luminance and low luminance shown in the first embodiment can be appropriately applied to the pulse width modulation with the slew rate control.

(2) Amplitude Modulation

The amplitude modulation is, not necessary to be illustrated, a method of representing a gradation by changing the amplitude potential of the modulation signal. Also in this modulation system, the amplitude potential of the modulation signal is made smaller upon display at the low luminance as same as the first embodiment, so that the luminance variation is made larger on the basis of the characteristic of the electron source shown in FIG. 5. Therefore, by applying the correction according to the present invention, it is possible to display the image having the reduced luminance variation and a high linearity.

In the amplitude modulation, since the amplitude potentials of the modulation signals for the number of gradations are applied, correction accuracy is improved if there are two or more luminance correction data sets.

(3) Pulse Width Modulation

Figure 14A:
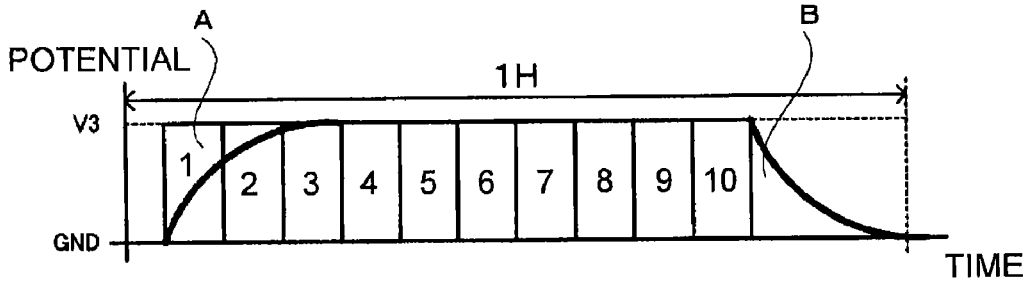
FIG. 14A is an explanatory view showing an example of a modulation signal.

An example of a modulation signal is shown in FIG. 14A. As same as the first embodiment, the numerals in the unit waveform (1 to 10) mean the values of the luminance data, and for example, when the luminance data is "5", waveforms corresponding to the numerals "1" to "5" in the rectangular are outputted as a modulation signal. In the pulse width modulation system, the pulse width is increased in accordance with the value of the signal (S6) to be inputted in the modulation driver 906. However, upon driving of the matrix panel, due to an output resistance (not illustrated) of the modulation driver 906 and a capacitance component of the modulation wiring 1001, the waveform of the modulation signal gets out of shape as represented by A and B in FIG. 14A.

Figure 14B:
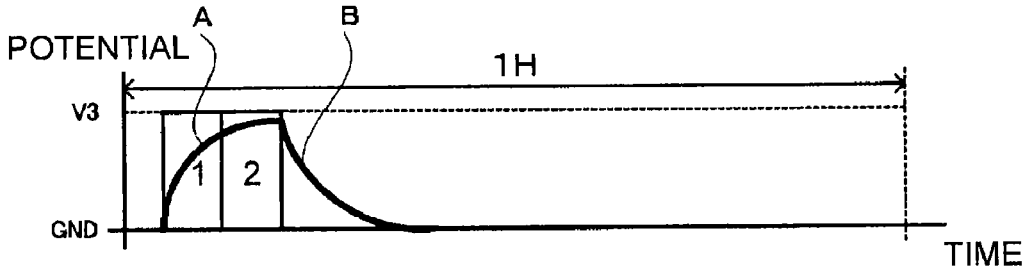
FIG. 14B is an explanatory view showing amplitude potential of an actual modulation signal of pulse width modulation.

An example of the waveform of the modulation signal when the display luminance is low (when the signal (S6) to be inputted in the modulation driver 906 is 2, for example) is shown in FIG. 14B. As being known from FIG. 14B, even though it is the pulse width modulation, the amplitude potential of the modulation signal is made small as represented by A and B of FIG. 14B.

In this way, the voltage to be added to the electron source 1004 in practice is made small in the pulse width modulation. Therefore, by applying the correction described in the first embodiment, it is possible to display the image having the reduced luminance variation and a high linearity.

Modification Example of Variation Correction

As the configuration for correcting variation of brightness of the pixel, the following modification examples can be preferably applied.

(1) Modification Example 1

Figure 15:
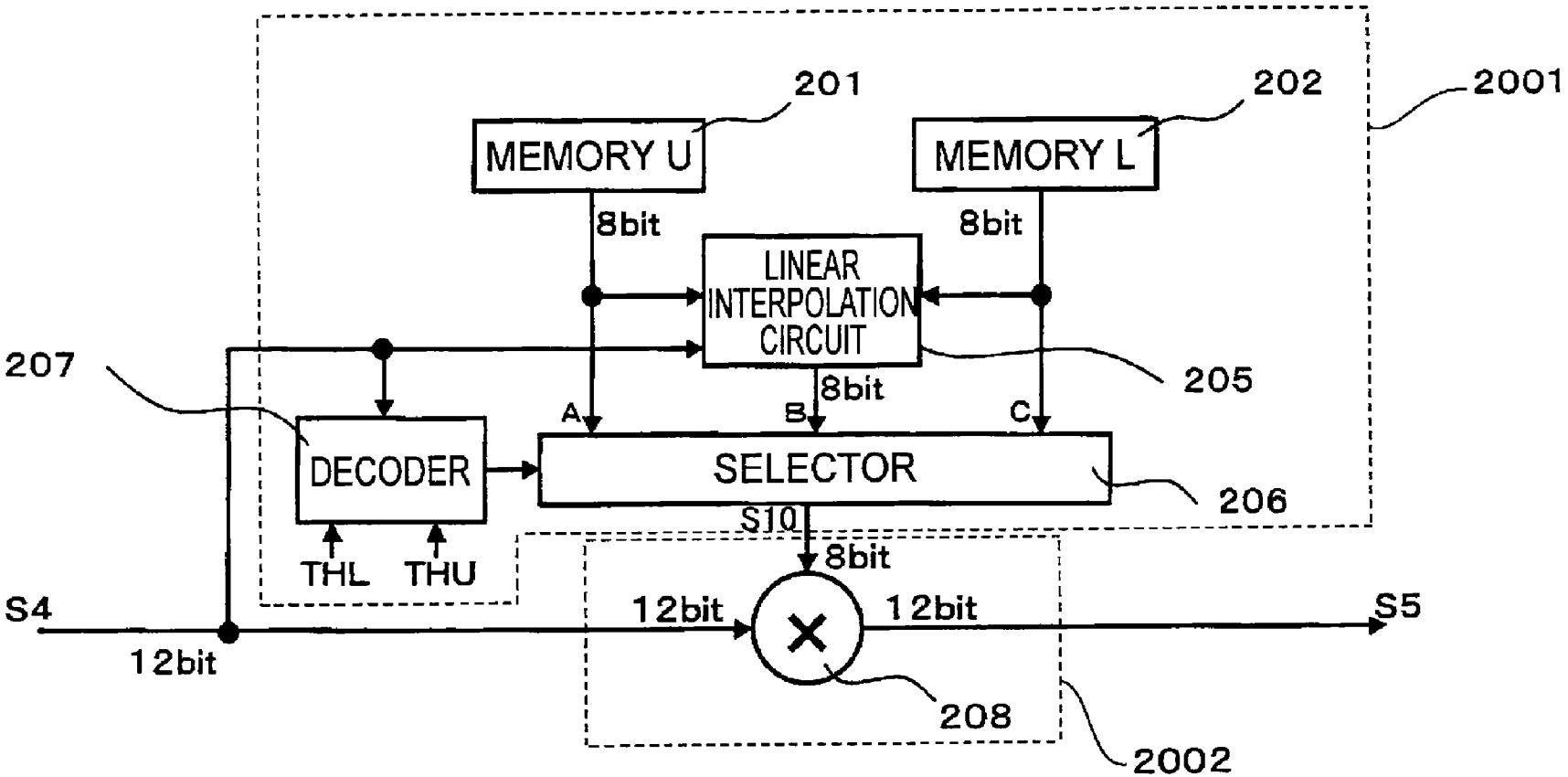
FIG. 15 is an explanatory view showing the constitution of a correction unit of a second embodiment according to the present invention.
Figure 16:
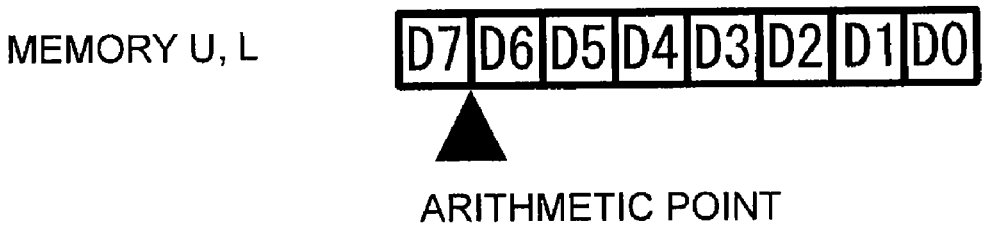
FIG. 16 is an explanatory view showing an example of a data storage method of a memory 201 and a memory 202 of to the second embodiment according to the present invention.

The numerals for explanation with reference to FIG. 15 are the same as the first embodiment, so that explanation thereof is herein omitted. According to the constitution of FIG. 15, when storing the correction value obtained from the measured luminance and the reference value of the luminance in the memory, the correction value is stored without deletion of the most significant bit and the least significant bit. Here, an example that the correction value to be stored is defined to be 8 bits will be described. The constitution of the bit of the correction value is shown in FIG. 16. According to this example, there is no necessity to perform bit expansion. The present embodiment is the same as the first embodiment other than making no bit expansion. When a degree of accuracy is needed, it is preferable that the bit widths of the memory U 201 and the memory L 202 to store the correction data set are defined to be 12 bits or the like.

(2) Modified Example 2

In the correction unit 2 shown in FIG. 1, by multiplying the correction data (S10) by the luminance data (S4), the correction luminance data (S5) is calculated. However, it is preferable that a table memory defining the correction data (S10) and the luminance data (S4) as input and defining the correction luminance data (S5) as output is used in place of the multiplier 208.

(3) Modified Example 3

The Configuration Using a Limiter

Figure 17:
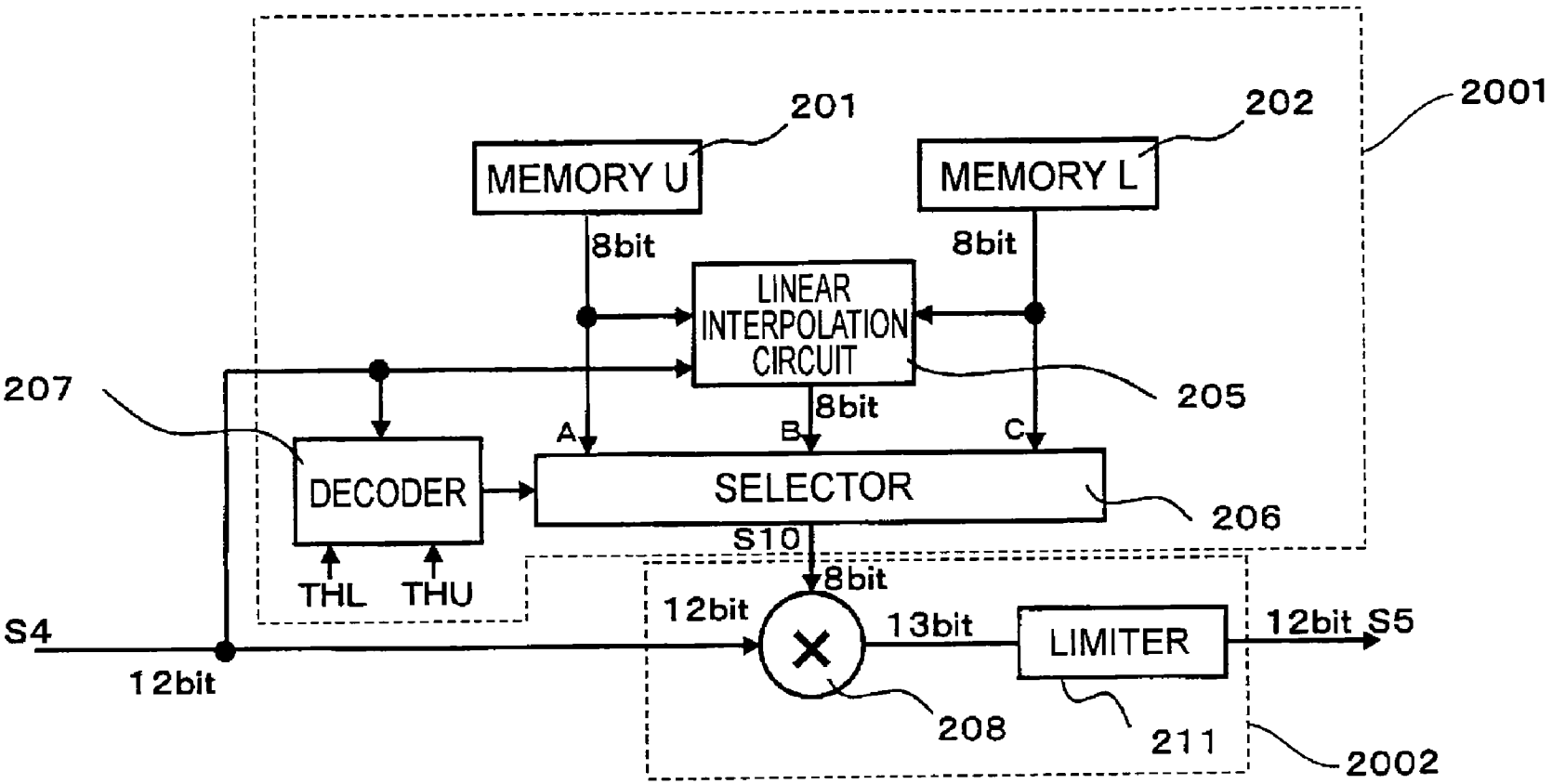
FIG. 17 is an explanatory view showing the constitution of a correction unit having a limiter.

The constitution of the correction unit 2 according to the modified example of this example is shown in FIG. 17. In FIG. 17, a reference numeral 211 denotes a limiter. In this configuration, the limiter 211 for limiting the upper limit of output of the multiplier is provided on the rear stage of the multiplier 208. According to the present modified example, the correction circuit 2002 is formed by the multiplier 208 and the limiter 211.

In order to explain the advantage of this limiter, the operation thereof will be described with reference to FIG. 15 having no limiter. In FIG. 15, a correction table upon display at the high luminance and display at the low luminance can have a value not less than 1. In the case that one or more correction data are multiplied, some luminance data may exceed the upper limit of the correction luminance data (in FIG. 15, it may exceed 12 bits). When the luminance data exceeds the upper limit of the correction luminance data (when the multiplication result of the multiplier 208 exceeds the data width), there is no upper digit and the correction luminance data takes a small value. Therefore, the display element that should be displayed bright is displayed dark and this deteriorates a quality of image display to a notable degree. In the constitution of FIG. 17 having a limiter, the data width of the multiplication result of the multiplier 208 is defined to be 13 bits. When the multiplication result exceeds 12 bits, the limiter 211 outputs the largest value of the data of 12 bits width (in FIG. 17, all of 12 bits are "1"). Therefore, there is no possibility that the image is deteriorated to a notable degree.

In addition, in the case that the luminance data is low, it is possible to correct the display element that cannot be corrected if the correction table has one or more values. Only when the luminance data that cannot be corrected is inputted (when the corrected result (the multiplication result of the multiplier 208) exceeds the data width), the limiter 211 may be operated. Thereby, the fact such that "the correction luminance data becomes a small value since there is no upper digit" is not realized of the correction luminance data S5, so that it is possible to correct the variation well while preventing deterioration.

<Setting of Target Luminance>

The target luminance may be set as same as the first embodiment also in these modified examples.

<Dither>

Normally, upon display of the gradation exceeding the number of gradations that can be displayed by the modulation driver 906, it is preferable that a dither is used. Specifically, an organizational dither or the like can be used. More preferably, since the variation of the device itself is corrected in the variation correction of the present invention, the dither in the time direction may be used when the gradations exceed the number of gradations that can be displayed by the modulation driver 906 due to the variation correction. In other words, the average luminance of a plurality of frames may correspond to the correction luminance data that is obtained by the variation correction of the present invention. As a result, by correcting the luminance unevenness that is a spacious distribution, the gradation can be displayed in a good condition.

As described above, even in the case of the constitution that is different from the first embodiment, it is possible to correct the luminance unevenness of the image display apparatus well.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-329307, filed on Dec. 6, 2006, which is hereby incorporated by reference herein in its entirety.

What is claimed is:

1. An image display apparatus comprising:

a plurality of pixels; and a drive circuit for outputting a modulation signal that drives the pixels on the basis of inputted driving data, wherein the drive circuit has a correction circuit for outputting the driving data that is corrected on the basis of a correction value, and wherein the correction value is a correction value that corrects variation of brightness of the plurality of pixels, and wherein the correction on the basis of the correction value is a correction such that a number of pixels to be darkened by the correction when the driving data inputted for the plurality of pixels have a common first value is fewer than a number of pixels to be darkened by the correction when the driving data inputted for the plurality of pixels have a common second value larger than the first value, and wherein a half-value width of a frequency distribution chart, in which a lateral axis represents brightness and a longitudinal axis represents the number of pixels in a case that brightness is measured by driving the plurality of pixels by the driving data having the first value without carrying out the correction by the correction circuit, is larger than a half-value width of a frequency distribution chart, in which a lateral axis represents brightness and a longitudinal axis represents the number of pixels in a case that brightness is measured by driving the plurality of pixels by the driving data having the second value without carrying out the correction by the correction circuit.

2. An image display apparatus according to claim 1, wherein the correction circuit has a multiplier for multiplying the correction value by the inputted driving data.

3. An image display apparatus according to claim 1, further comprising a circuit for outputting the highest value in a first data width as the corrected driving data when the corrected driving data exceeds the highest value in the first data width.

4. An image display apparatus comprising:

a plurality of pixels; and a drive circuit for outputting a modulation signal that drives the pixels on the basis of inputted driving data, wherein the drive circuit having:

a correction value output circuit for outputting a first correction value for each of the plurality of pixels when the inputted driving data is a first value, the first correction value being used for correcting the driving data so that brightness of the pixel driven on the basis of the driving data comes close to a first brightness that is a reference, and for outputting a second correction value for each of the plurality of pixels when the inputted driving data is a second value larger than the first value, the second correction value being used for correcting the driving data so that brightness of the pixel driven on the basis of the driving data comes close to a second brightness that is a reference; and a correction circuit for carrying out correction on the basis of the correction value outputted from the correction value output circuit, and wherein the number of the correction values to lower brightness of the pixel among the plurality of second correction values corresponding to the plurality of pixels is more than the number of the correction values to lower brightness of the pixel among the plurality of first correction values corresponding to the plurality of pixels.

5. An image display apparatus according to claim 4, wherein the correction circuit carries out correction by using a correction value of m bits, m being a natural number larger than n, that is obtained by adding 0 as the most significant bit to the first correction value of n bits, n being a natural number, that is outputted from the correction value output circuit.

6. An image display apparatus according to claim 4, wherein the correction circuit carries out correction by using a correction value of q bits, q being a natural number larger than p, that is obtained by adding 0 as the least significant bit to the second correction value of p bits, p being a natural number, that is outputted from the correction value output circuit.

7. An image display apparatus according to claim 4, wherein the correction circuit carries out correction using a correction value that is obtained by interpolating the first and second correction values corresponding to the same pixel.

8. An image display apparatus according to claim 4, wherein the correction circuit has a multiplier for multiplying the correction value by the inputted driving data.

9. An image display apparatus according to claim 4, further comprising a circuit for outputting the highest value in a first data width as the corrected driving data when the corrected driving data exceeds the highest value in the first data width.

10. An image display apparatus according to claim 4, wherein a half-value width of a frequency distribution chart, in which a lateral axis represents brightness and a longitudinal axis represents the number of pixels in a case that brightness is measured by driving the plurality of pixels by the driving data having the first value without carrying out the correction by the correction circuit, is larger than a half-value width of a frequency distribution chart, in which a lateral axis represents brightness and a longitudinal axis represents the number of pixels in a case that brightness is measured by driving the plurality of pixels by the driving data having the second value without carrying out the correction by the correction circuit.

11. An image display apparatus comprising:

a plurality of pixels; and a drive circuit for outputting a modulation signal that drives the pixels on the basis of inputted driving data, wherein the drive circuit having:

a correction value output circuit for outputting a correction value in order to correct variation of brightness of a plurality of pixels; and a correction circuit for carrying out correction on the basis of the correction value outputted from the correction value output circuit, and wherein the correction value output circuit can output a first correction value and a second correction value for each of the plurality of pixels, and wherein the correction value output circuit outputs:

(a) the first correction value, for a pixel which has a brightness lower than a first brightness in case of driven on the basis of driving data of a first value without correction by the correction circuit, in order to increase the brightness of the pixel, when the inputted driving data is the first value;

(b) the first correction value, for a pixel which has a brightness higher than the first brightness in case of driven on the basis of driving data of the first value without correction by the correction circuit, in order to lower the brightness of the pixel, when the inputted driving data is the first value;

(c) the second correction value, for a pixel which has brightness lower than a second brightness in case of driven on the basis of driving data of a second value larger than the first value without correction by the correction circuit, in order to increase the brightness of the pixel, when the inputted driving data is the second value; and (d) the second correction value, for a pixel which has a brightness higher than the second brightness in case of driven on the basis of driving data of the second value without correction by the correction circuit, in order to lower the brightness of the pixel, when the inputted driving data is the second value, and wherein the number of pixels that are brighter than the first brightness in the case that the plurality of pixels are driven on the basis of the driving data of the first value without the correction by the correction circuit is fewer than the number of pixels that are brighter than the second brightness in the case that the plurality of pixels are driven on the basis of the driving data of the second value without the correction by the correction circuit.

12. An image display apparatus according to claim 11, wherein the correction circuit carries out correction by using a correction value of m bits, m being a natural number larger than n, that is obtained by adding 0 as the most significant bit to the first correction value of n bits, n being a natural number, that is outputted from the correction value output circuit.

13. An image display apparatus according to claim 11, wherein the correction circuit carries out correction by using a correction value of q bits, q being a natural number larger than p, that is obtained by adding 0 as the least significant bit to the second correction value of p bits, p being a natural number, that is outputted from the correction value output circuit.

14. An image display apparatus according to claim 11, wherein the correction circuit carries out correction using a correction value that is obtained by interpolating the first and second correction values corresponding to the same pixel.

15. An image display apparatus according to claim 11, wherein the correction circuit has a multiplier for multiplying the correction value by the inputted driving data.

16. An image display apparatus according to claim 11, further comprising a circuit for outputting the highest value in a first data width as the corrected driving data when the corrected driving data exceeds the highest value in the first data width.

17. An image display apparatus according to claim 11, wherein a half-value width of a frequency distribution chart, in which a lateral axis represents brightness and a longitudinal axis represents the number of pixels in a case that brightness is measured by driving the plurality of pixels by the driving data having the first value without carrying out the correction by the correction circuit, is larger than a half-value width of a frequency distribution chart, in which a lateral axis represents brightness and a longitudinal axis represents the number of pixels in a case that brightness is measured by driving the plurality of pixels by the driving data having the second value without carrying out the correction by the correction circuit.

* * * * *